US010530109B2

(12) United States Patent
Helmick

(10) Patent No.: US 10,530,109 B2
(45) Date of Patent: Jan. 7, 2020

(54) AUTOMATED SYSTEMS AND METHODS FOR MANUFACTURING ELECTRICAL CONNECTORS USING UNIVERSAL CONNECTOR SUPPORT ASSEMBLIES

(71) Applicant: THE BOEING COMPANY, Chicago, IL (US)

(72) Inventor: Eerik J. Helmick, Seattle, WA (US)

(73) Assignee: The Boeing Company, Chicago, IL (US)

( * ) Notice: Subject to any disclaimer, the term of this patent is extended or adjusted under 35 U.S.C. 154(b) by 883 days.

(21) Appl. No.: 14/826,291

(22) Filed: Aug. 14, 2015

(65) Prior Publication Data

US 2017/0047698 A1 Feb. 16, 2017

(51) Int. Cl.
*H01R 43/20* (2006.01)

(52) U.S. Cl.
CPC ..... *H01R 43/20* (2013.01); *Y10T 29/53209* (2015.01)

(58) Field of Classification Search
CPC ... Y10T 29/53209; Y10T 29/53; H01R 43/20; H01R 43/00; H01R 43/16
USPC ..... 29/747, 745, 729, 700; 901/31, 7, 8, 12, 901/16, 1
See application file for complete search history.

(56) References Cited

U.S. PATENT DOCUMENTS 4,649,633 A * 3/1987 Bocchicchio ..... H01R 43/205 29/739
4,680,523 A * 7/1987 Goumas ..... B25J 13/082 318/685
4,717,304 A * 1/1988 Bocchicchio ..... H05K 13/0084 221/11
4,837,926 A * 6/1989 Boutcher, Jr. ..... H01R 43/20 269/43
4,865,375 A * 9/1989 Laub ..... B25J 15/0253 294/207
5,099,572 A 3/1992 Lazaro
5,387,068 A * 2/1995 Pearson ..... B25J 15/0616 294/65
8,099,857 B2 1/2012 Shelley

* cited by examiner

*Primary Examiner* — Peter Dungba Vo
*Assistant Examiner* — Azma A Parvez
(74) *Attorney, Agent, or Firm* — Joseph M. Butcher; The Small Patent Law Group, LLC

(57) ABSTRACT

A connector support assembly is configured to securely retain an electrical connector during a manufacturing process. The connector support assembly may include a base, a first securing member, and a second securing member. The first and/or second securing members is movable, and is configured to be moved between an open position in which a mating connector of the electrical connector is positioned between the first and second securing members, and a clamped position in which the mating connector is securely clamped between the first and second securing members.

39 Claims, 12 Drawing Sheets

AUTOMATED SYSTEMS AND METHODS FOR MANUFACTURING ELECTRICAL CONNECTORS USING UNIVERSAL CONNECTOR SUPPORT ASSEMBLIES

FIELD OF THE DISCLOSURE

Embodiments of the present disclosure generally relate to systems and methods for manufacturing an electrical connector, and, more particularly, to automated systems and methods for manufacturing electrical connectors using universal connector support assemblies that are configured to support a wide variety of connectors.

BACKGROUND OF THE DISCLOSURE

Automated systems are used to manufacture a variety of devices and structures. One type of system may include multiple robotic systems that are used to form an electrical connector, including a shell, a grommet, and electrical wires. For example, a robotic system may include an arm with an operative end that securely and precisely connects electrical wires to a grommet that connects to a shell.

In order to precisely and accurately form an electrical connector, the shell is securely mounted to a connector support, otherwise known as a boat. Typically, the connector support includes a base. A fixed support pedestal extends from the base. The fixed support pedestal includes one or more unique retaining features that are configured to securely retain a specific type of connector shell having a defined size and shape. For example, the support pedestal may include an annular channel that is sized and shaped to receive a portion of a particular connector shell having a unique size and shape. As another example, the support pedestal may include a retaining channel that is sized and shaped to receive and retain a portion of a particular connector shell having a unique size and shape.

In general, a connector support includes a fixed, hard locating machined fixture that mates to a connector. For each different type of connector there is a specialized and unique connector support. A manufacturer of a wide variety of electrical connectors stores corresponding connector supports for each type of electrical connector. Moreover, each connector shell is typically manually secured to a support pedestal, such as through threading, keying, and/or the like. As can be appreciated, the process of manufacturing components may be expensive (in that a large number of separate and distinct connector supports are used and stored), and time and labor intensive (in that each connector shell is manually secured to a connector support).

Accordingly, a need exists for an efficient automated system and method of manufacturing components, such as electrical connectors.

SUMMARY OF THE DISCLOSURE

Certain embodiments of the present disclosure provide a connector support assembly configured to securely retain an electrical connector during a manufacturing process. The connector support assembly may include a base, a first securing member, and a second securing member. The first and/or second securing member is movable, and is configured to be movable between an open position in which a mating connector of the electrical connector is positioned between the first and second securing members, and a clamped position in which the mating connector is securely clamped between the first and second securing members.

In at least one embodiment, the first securing member or the second securing member is fixed in position with respect to the base. The other securing member is moveable. One or both of the first and second securing members may be spring-biased towards or otherwise in a closed position. The connector support assembly is configured to securely retain a variety of mating connectors that differ in one or both of size or shape.

In at least one embodiment, one or both of the first and second securing members is configured to be engaged by an actuator to move one or both of the first and second securing members into the open position. In at least one other embodiment, one or both of the first and second securing members is configured to be engaged by an end effector of an engaging robot to move one or both of the first and second securing members into the open position.

The connector support assembly may further include at least one end wall extending from the base, and at least one rail connected to the end wall. One or both of the first and second securing members is slidably secured on the rail(s) through at least one bearing. The bearing(s) may be offset with respect to one or both of the first and second securing members.

At least one of the first and second securing members may include an outer wall, lateral walls connected to the outer wall, and a connector interface wall extending between the lateral walls opposite from the outer wall. The connector interface wall is configured to abut into a portion of the mating connector. The connector interface wall may include at least one angled surface configured to abut against a portion of the mating connector. The outer wall may include an actuator opening. The actuator opening may be configured to receive a rod or a portion of an actuator that is configured to be engaged to move one or both of the first and second securing members into the open position. The connector interface wall may include a shell chamber that is configured to conform to a portion of an outer surface of the mating connector.

One or both of the securing members may include a marking and/or a protuberance that is configured to be detected by a feature recognition system that is used to orient the mating connector within the connector support assembly.

In at least one embodiment, both of the first and second securing members are moveable. For example, each of the first and second securing members may include a rack. At least one pinion gear may be rotatably secured to the base. The pinion gear(s) engages the rack of each of the first and second securing members to maintain a symmetrical relationship of the first and second securing members about a central lateral axis. In at least one other embodiment, the first and second securing members are moveably secured together through a scissor link.

One or both of the first and second securing members may include at least one peaked ramp. The peaked ramp(s) is configured to be engaged by an end effector of an engaging robot to spread one or both of the first and second securing members into the open position.

In at least one embodiment, a cam gear is operatively coupled to one of the first and second securing members. The cam gear may include a rack, a pinion gear coupled to the rack, a cam coupled to the pinion gear, and a link connecting the cam to one of the first and second securing members.

In at least one embodiment, the connector support assembly may include opposed end brackets extending from the base. The first securing member is moveably secured between the opposed end brackets. The connector support assembly may also include opposed side brackets extending from the base. The second securing member is moveably secured between the opposed side brackets. The second securing member may include a channel through which the first securing member passes and moves.

In at least one embodiment, one or both of the first and second securing members may include lateral protuberances that are configured to constrain lateral shifting of the mating connector in the clamped position.

Certain embodiments of the present disclosure provide a system for manufacturing an electrical connector. The system may include a plurality of mating connectors, in which at least two of the plurality of mating connectors differ in one or both of size and shape. The system may also include a first engaging robot having an end effector that is configured to grasp each of the plurality of mating connectors, and a connector support assembly configured to securely retain each of the plurality of the mating connectors. The first engaging robot is configured to position one of the plurality of mating connectors into the connector support assembly. The connector support assembly may include a base, a first securing member, and a second securing member. One or both of the first and second securing members is movable. One or both of the first and second securing members is moved between an open position in which one of the plurality of mating connectors is positioned between the first and second securing members, and a clamped position in which the one of the plurality of mating connectors is securely clamped between the first and second securing members.

The system may also include a conveyor configured to convey the connector support assembly, and one or more automated tools connected to the conveyor. The automated tool(s) is configured to secure one or more components to the mating connectors. The system may also include a pallet configured to moveably secure the base of the connector support assembly to the conveyor. The system may also include a second engaging robot that is configured to remove a fully formed electrical connector from the connector support assembly.

The system may also include an actuator configured to actuate the connector support assembly into the open position. In at least one other embodiment, the end effector of the first engaging robot is configured to actuate the connector support assembly into the open position.

Certain embodiments of the present disclosure provide a method for manufacturing an electrical connector. The method may include storing a plurality of mating connectors. At least two of the plurality of mating connectors differ in one or both of size and shape. The method may also include grasping one of the plurality of mating connectors with an end effector of a first engaging robot, moving the mating connector with the end effector to a connector support assembly, actuating one or both of first and second securing members of the connector support assembly into an open position, using the end effector to position the mating connector between the first and second securing members, and securely clamping the mating connector between the first and second securing members.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide a universal connector support assembly that is configured securely locate and hold a connector during various processing stages used to fully form the connector. The connector support assembly supports a variety of connector sizes and shapes. As such, embodiments of the present disclosure greatly reduce a number of connector supports that are used to manufacture a variety of connector types. Additionally, embodiments of the present disclosure provide a connector support assembly that may be devoid of threads of keys, thereby allowing for an efficient automated manufacturing system and method. The connector support assembly may be used to securely retain connectors during seal plug insertion and wire insertion processes.

Certain embodiments of the present disclosure provide a method of manufacturing an electrical connector that may include grasping a connector with an end effector of a robotic system. For example, the end effector may include one or more forceps-like robotic grips. The method may also include using a feature recognition system (such as a visual, laser, infrared, photogrammetry, or the like system) to orient the connector with respect to a connector support assembly. The connector support assembly may be actuated to securely clamp onto the connector. The feature recognition system may be used to determine a location and orientation of the connector within the connector support assembly, which may be monitored during the manufacturing method to ensure proper positioning of various components of the electrical connector.

Figure 1:
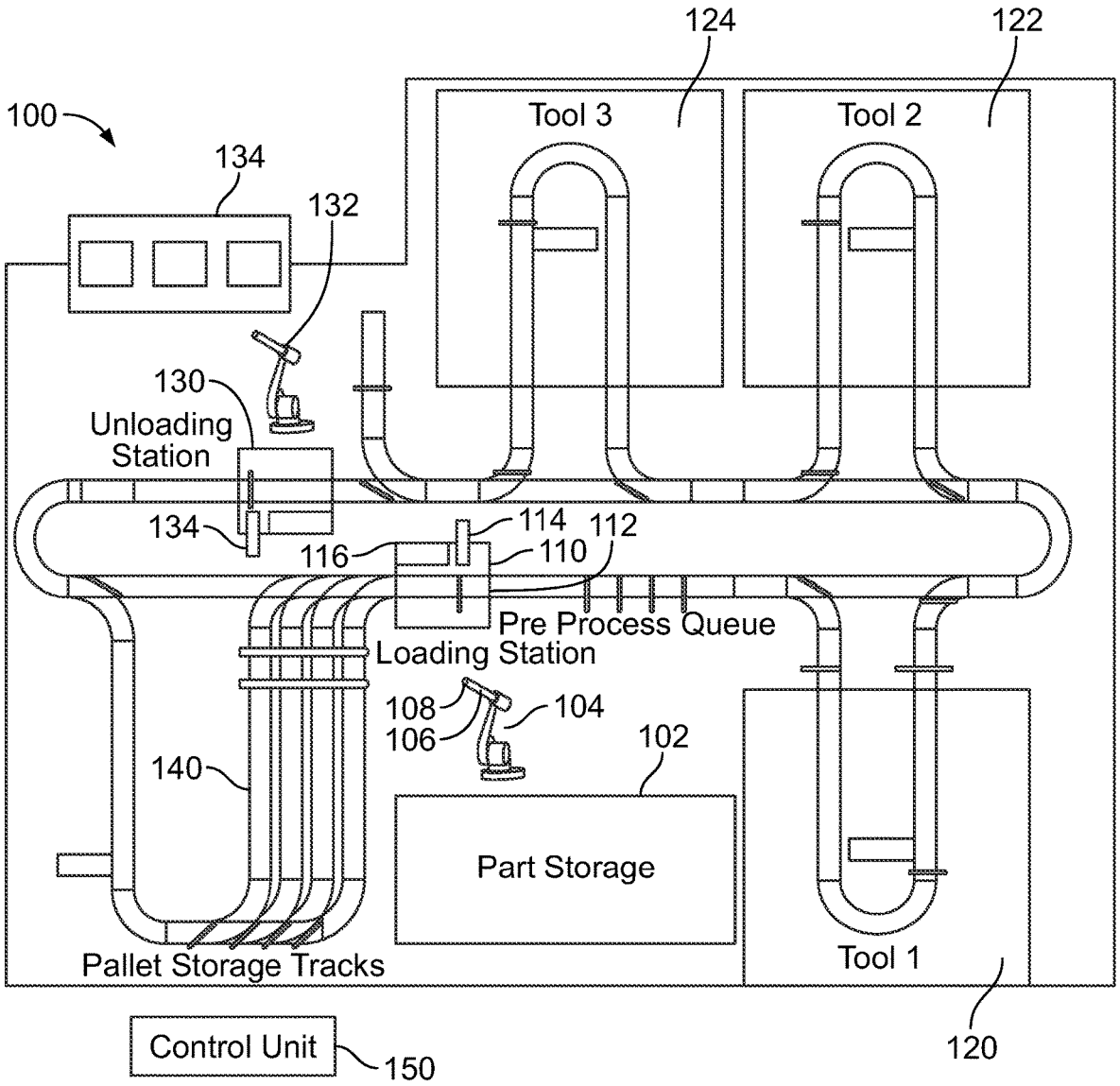
FIG. 1 illustrates a schematic diagram of a manufacturing system for an electrical connector, according to an embodiment of the present disclosure.

FIG. 1 illustrates a schematic diagram of a system 100 of manufacturing an electrical connector, according to an embodiment of the present disclosure. The system 100 may include a part storage pen 102, which may contain multiple electrical mating connectors. An engaging robot 104 having an arm 106 and an end effector 108 is configured to grasp a particular mating connector from the part storage pen 102 and transfer the mating connector to a loading station 110, which may be disposed along a conveyor 112. The conveyor 112 (such as a moving conveyor line, track, or the like) may moveably support a pallet (not shown in FIG. 1). A connector support assembly (not shown in FIG. 1) may be supported on the pallet. As such, the pallet may moveably secure the connector support assembly on the conveyor 112.

An actuator 114 (such as a pneumatic, electrical, piezoelectric, servo motor, or the like driven piston) may engage the connector support assembly to move one or more securing members of the connector support assembly into an open or receiving position. Optionally, a portion of the engaging robot 104, such as the end effector 108, may be used to actuate the connector support assembly into the open or receiving position.

The engaging robot 104 may position the mating connector within the connector support assembly, which is actuated into the open position. After the mating connector is positioned within the connector support assembly, the actuator 114 disengages the connector support assembly, thereby allowing the securing member(s) to securely clamp onto the mating connector. For example, the connector support assembly may include one or more spring-biased securing members that are biased towards a closed position, and clamp onto portions of the mating connector after the actuator 114 disengages the connector support assembly.

A connector detection system, such as an RFID reader 116, may detect the type of mating connector. The system 100 may be used to accurately and automatically form an electrical connector based on the type of mating connector that is detected through various processing stages. Additional RFID readers may be disposed along the conveyor 112 at various stages.

At least one of the securing members is moveable. Each of the securing members may be one or more of a wall, a block, a jaw, an arm, a beam, a clamp, a rail, a bracket, other such protuberance, or the like. The securing members may be formed of metal and/or plastic. In at least one embodiment, connector interface surfaces of the securing members may include a resilient surface, such as formed of rubber, that conforms to an outer surface of a mating connector and reduces a possibility of damage to the mating connector (for example, reduces a possibility of scratching, marring, or the like).

One or both of the engaging robot 104 and/or the loading station 110 may also include a feature recognition system (not shown in FIG. 1). The feature recognition system may be or include a laser, infrared, visual, photogrammetry, or the like system that is used to detect a feature of the mating connector (such as a protuberance or mark on a grommet) and align it with a feature on the connector support assembly (such as a protuberance, mark, or the like) in order to ensure that the mating connector is properly aligned and oriented on the connector support assembly during various processing stages.

After the mating connector is secured to the connector support assembly, the pallet, on which the connector support assembly may be positioned, is conveyed to various tools 120, 122, and 124 on the conveyor 112. The tools 120, 122, and 124 may be used to secure various components to the mating connector to form an electrical connector. For example, the tool 120 may secure conductive wires to a grommet of the mating connector. The tool 122 may position a seal around a portion of the mating connector. The tool 124 may position a mating interface on an end of the mating connector. More or less tools 120, 122, and 124 and stations than shown may be used.

After the electrical connector is formed through operation of the tools 120, 122, and 124, the electrical connector may be conveyed on the conveyor 112 (via the connector support assembly supported on a pallet) to an unloading station 130. An engaging robot 130 is used to remove the electrical connector from the connector support assembly. For example, an actuator 134 may be used to disengage the securing member(s) from the mating connector so that the engaging robot 130 may grasp and remove the electrical connector from the connector support assembly. The engaging robot 132 may then transfer the formed electrical connector to a connector storage structure 134, such as a shelf, bucket, trough, or the like. The pallet and connector support assembly are then conveyed to pallet storage tracks 140 which connect to the loading station 110.

A control unit 150 may be in communication with the engaging robots 104 and 132, as well as the various tools 120, 122, and 124. For example, the control unit 150 may be in communication with these components through wired and/or wireless connections. The control unit 150 may be configured to control operation of the manufacturing system and method. That is, the control unit 150 may include hardware and software that stores programs that are used to control operation of the various components of the system 100.

Figure 2:
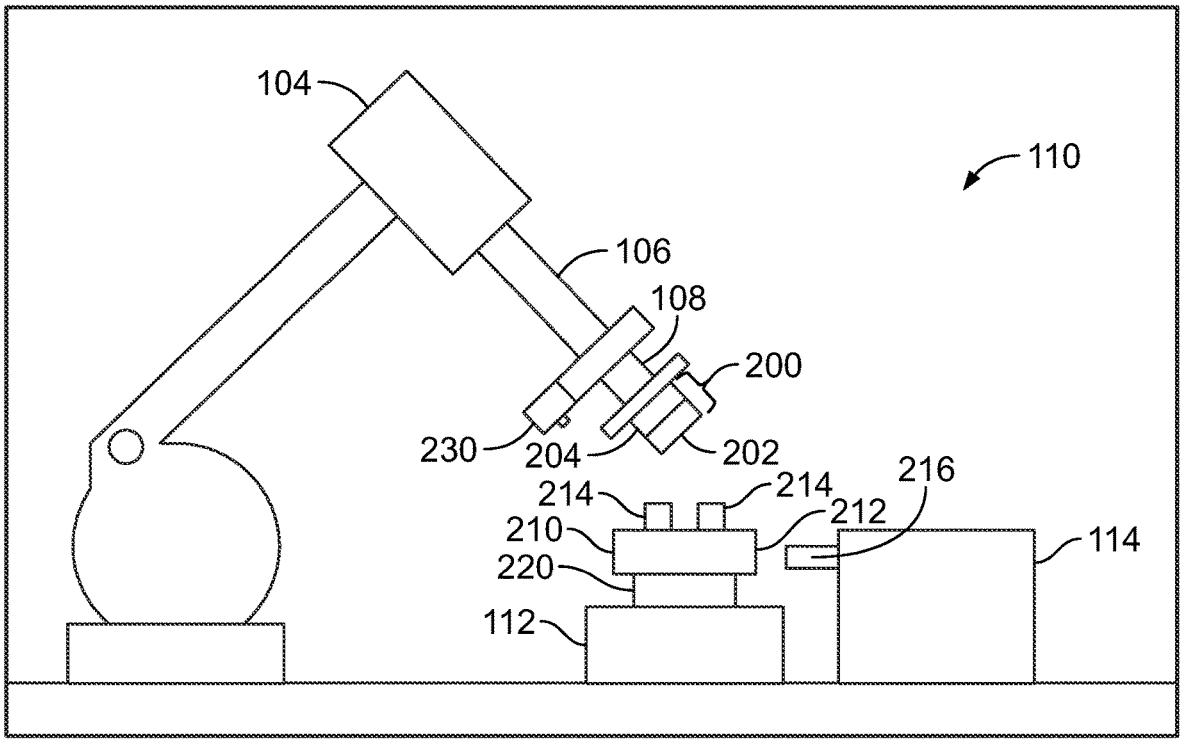
FIG. 2 illustrates a schematic diagram of a loading station, according to an embodiment of the present disclosure.

FIG. 2 illustrates a schematic diagram of the loading station 110, according to an embodiment of the present disclosure. While FIG. 2 shows the loading station 110, the unloading station 130 may be configured in a similar fashion. The engaging robot 104 includes the arm 108 having the end effector 110. The end effector 108 grasps a mating connector 200, which may include a shell 202 and a grommet 204. The engaging robot 104 is configured to position the mating connector 200 onto a connector support assembly 210, which may include a base 212 and opposed securing members 214. One or both of the securing members 214 may be configured to be actuated into an open receiving position by the actuator 114. The actuator 114 may include a main housing that contains a motor (such as a pneumatic, servo, electric, piezoelectric, or the like motor) that is coupled to an actuating piston 216. The actuator 114 engages one or both of the securing members 214 with the piston 216 (or a separate and distinct rod secured to the connector support assembly 210) to spread the securing members 214 open into the receiving position. In response to the securing members 214 being spread into the open receiving position, the engaging robot 104 positions the mating connector 200 between the securing members 214. The actuator 114 then releases the piston 216 from the connector support assembly 210. In response to the actuator 114 disengaging the connector support assembly 210, the securing members 214 clamp onto the mating connector 200, such as through spring force.

For example, the securing members 214 may be spring-biased towards one another. As such, the securing members 214 may be biased toward one another in an at-rest position. The actuator 114 engages one or both of the securing members 214 to overcome the spring force, thereby opening the securing members 214 into the receiving position. As the actuator 114 releases from the securing member(s) 214, the spring force causes the securing members 214 to close (and/or clamp around the mating connector 200).

In at least one other embodiment, the securing members 214 may not be spring biased. The actuator 114 may include a hook, clasp, latch, or other such protuberance that is configured to push and/or pull the securing members 214 between the open receiving position and a clamped position.

In at least one other embodiment, the actuator 114 may not be used. Instead, the end effector 110 of the engaging robot 104 may be configured to engage one or more portions of at least one of the securing members 214 to move the securing member(s) 214 into an open receiving position, for example.

The connector support assembly 210 may be positioned on a pallet 220 that is moveably retained by the conveyor 112. As such, the connector support assembly 210 may be conveyed on the conveyor 112 by the pallet 220. In at least one other embodiment, the conveyor 112 may be configured to moveably retain the base 212 of the connector support assembly 210, instead of using the separate pallet 220.

The engaging robot 104 may also include a feature recognition system 230, such as a laser, infrared, visual, photogrammetry, or other such identification system. The feature recognition system 230 may identify one or more features of the mating connector 200 and one or more features of the connector support assembly 210. The feature recognition system 230 may identify a proper orientation of the feature(s) of the mating connector 200 with the feature(s) of the connector support assembly 210. The engaging robot 104 may then properly orient the mating connector 200 in relation to the connector support assembly 210 based on the identified features. Alternatively, the feature recognition system 230 may be separate and distinct from the engaging robot.

Figure 3:
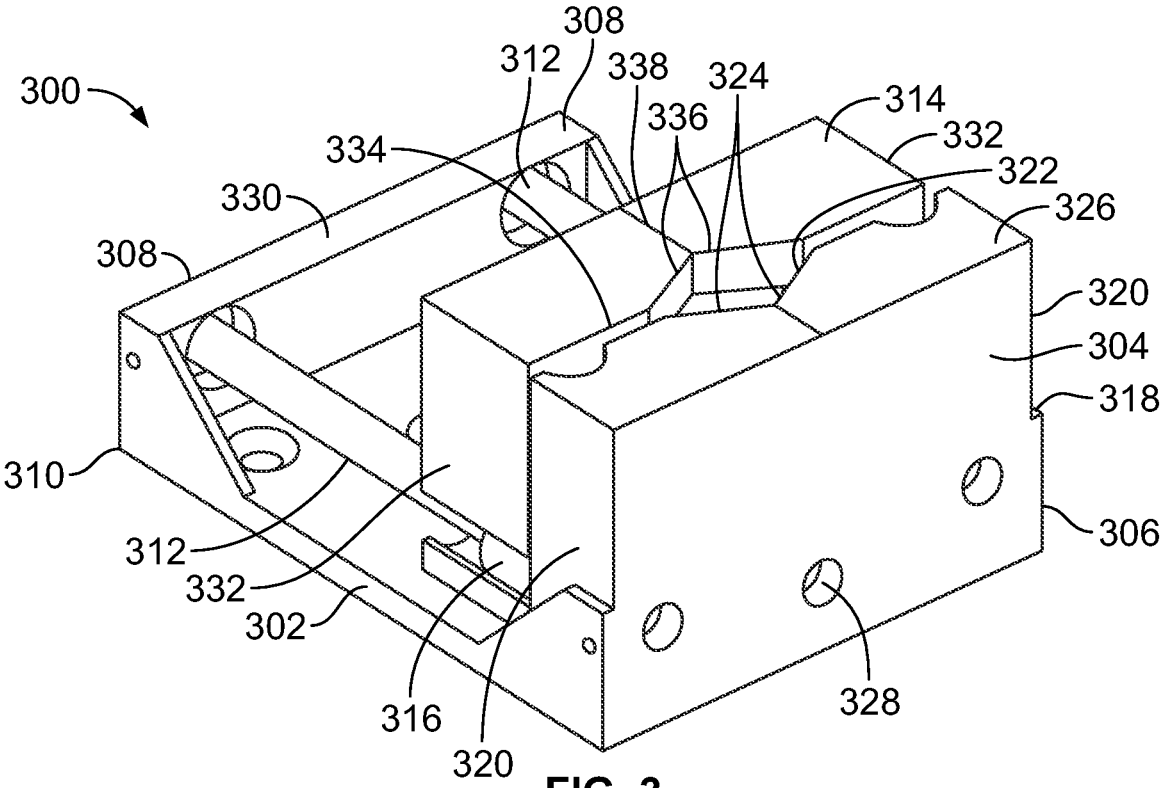
FIG. 3 illustrates a perspective top view of a connector support assembly in a closed position, according to an embodiment of the present disclosure.

FIG. 3 illustrates a perspective top view of a connector support assembly 300 in a closed position, according to an embodiment of the present disclosure. The connector support assembly 300 is an example of the connector support assembly 210 shown in FIG. 2. The connector support assembly 300 includes a base 302 having a first securing member 304 upwardly extending from a first end 306. An end wall 308 extends from the base 302 at a second end 310 that is opposite from the first end 306. The first securing member 304 may be fixed in position. That is, the first securing member 304 may not be configured to move in relation to the base 302.

A pair of rails 312 extend between the first securing member 304 and the end wall 308. A second securing member 314 that opposes the first securing member 304 is slidably positioned on the rails 312 through bearings 316. One or more springs may be positioned around and/or in portions of the rails 312 and are configured to bias the second securing member 314 into or towards the first securing member 314 in the closed position (which may be the at-rest position).

The first securing member 304 may include an outer wall 318 connected to lateral walls 320. The outer wall 318 may be a planar, flat wall that connects to the lateral walls 320 at right angles. The lateral walls 320 connect to a connector interface wall 322 that is opposite from the outer wall 318. The connector interface wall 322 may include symmetrical recessed top walls 324 that rearwardly angle toward a central plane 326. The recessed walls 324 are configured to engage around a portion of a mating connector, such as a portion of a grommet. Alternatively, the connector interface wall 322 may be curved, flat, or various other shapes depending on a shape of a class of connectors that are configured to be clamped between the first and second securing members 304 and 314.

An actuator opening 328 may be formed through the outer wall 318. The actuator opening 328 is configured to receive a distal end of the piston 216 (shown in FIG. 2) in order to spread the second securing member 314 away from the first securing member 304. Optionally, a rod may be slidably positioned within the actuator opening 328.

Similar to the first securing member 304, the second securing member 314 may include an outer wall 330 connected to lateral walls 332. The outer wall 330 may be a planar, flat wall that connects to the lateral walls 332 at right angles. The lateral walls 332 connect to a connector interface wall 334 that is opposite from the outer wall 330. The connector interface wall 334 may include symmetrical recessed top walls 336 that rearwardly angle toward a central plane 338. The recessed walls 336 are configured to engage around a portion of a mating connector. Alternatively, the connector interface wall 334 may be curved, flat, or various other shapes depending on a shape of a class of connectors that are configured to be clamped between the first and second securing members 304 and 314.

In order to position the securing members 304 and 314 into the open receiving position, the actuator 114 drives the piston 216 into the actuator opening 328. The piston 216 passes through the actuator opening 328 and engages a support block or other portion of the second securing member 314 to push the second securing member 314 away from the first securing member 304.

Figure 4:
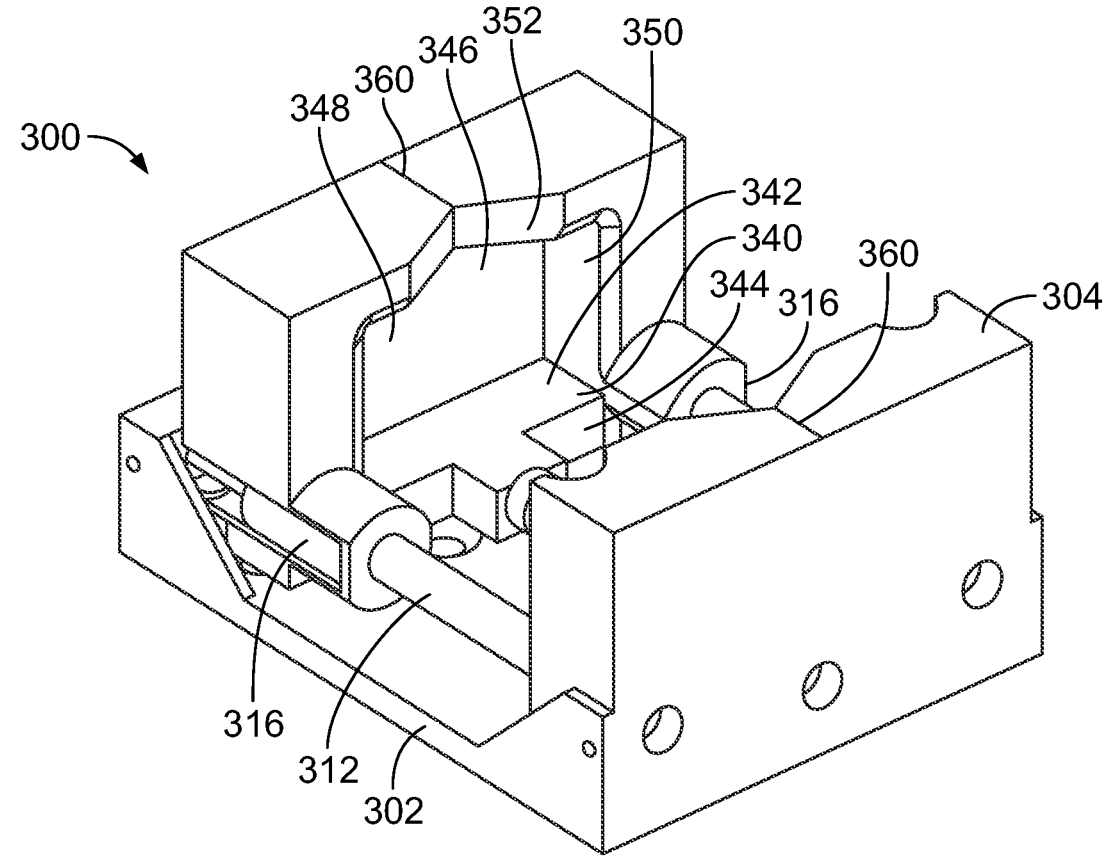
FIG. 4 illustrates a perspective top view of a connector support assembly in an open receiving position, according to an embodiment of the present disclosure.

FIG. 4 illustrates a perspective top view of the connector support assembly 300 in an open receiving position, according to an embodiment of the present disclosure. As shown, the second securing member 314 includes the support block 340 having an upper surface 342 that connects to a perpendicular interior surface 344 that is configured to be engaged by a distal end of the piston 216 of the actuator 114 (shown in FIG. 1). A shell chamber 346 may be formed between the upper surface 342, a back wall 348, interior lateral walls 350, and an interior upper wall 352. The shell chamber 346 is configured to receive a portion (such as one half) of an outer circumference of the shell 202 of the mating connector 200 (shown in FIG. 2), while the recessed walls 336 are configured to receive a portion (such as one half) of an outer circumference of the grommet 204 (shown in FIG. 2). Similarly, a shell chamber may be formed through the first securing member 304. Alternatively, the connector support assembly 300 may not include shell chambers as shown. For example, interior walls of the first and second securing members may be flat.

The actuator 114 overcomes the spring force exerted into the second securing member 314 to slide the second securing member 314 on the rails 312 away from the first securing member 304 into the open receiving position. In response to the connector support assembly 300 being moved into the open receiving position by the actuator 114, the engaging robot 104 may position the mating connector 200 between the first and second securing members 314. One or both of the first and second securing members 304 and 314 may include visually recognizable features 360 (such as lines, marks, protuberances, or the like) that may be recognized by the feature recognition system 230 (shown in FIG. 2) and used to align the mating connector 210 with respect to the connector support assembly 300.

Figure 5:
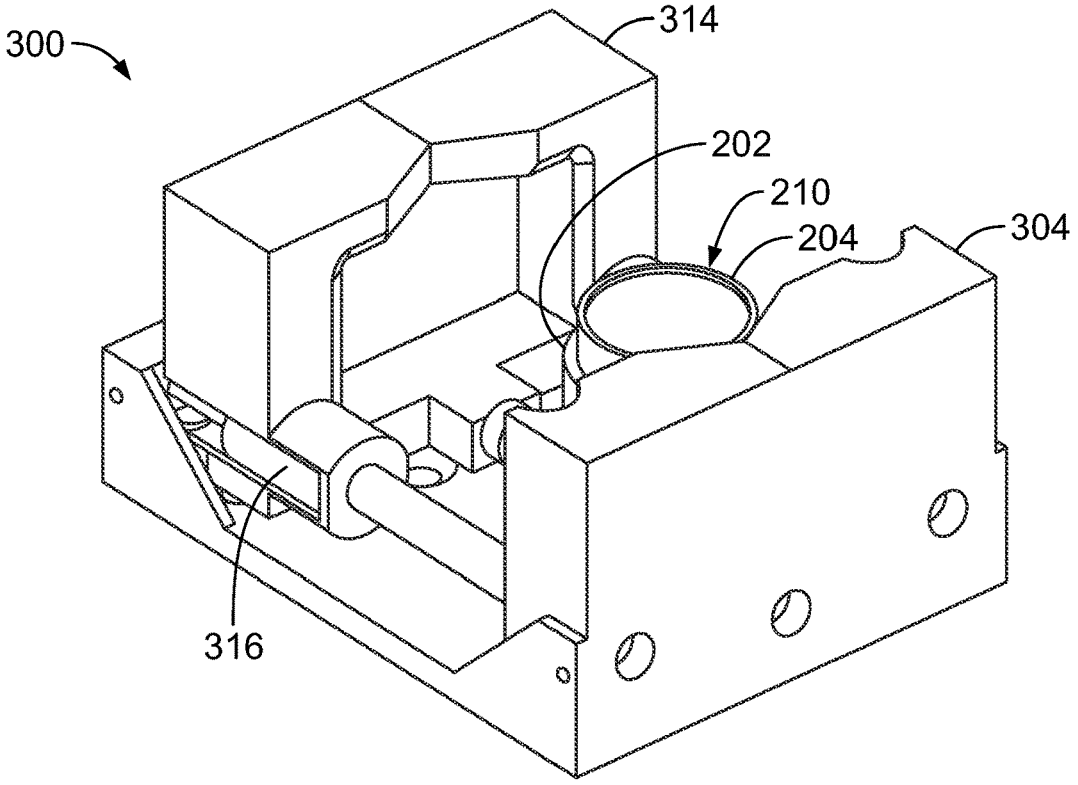
FIG. 5 illustrates a perspective top view of a mating connector positioned between opposed securing members of a connector support assembly in an open receiving position, according to an embodiment of the present disclosure.

FIG. 5 illustrates a perspective top view of the mating connector 210 positioned between the opposed first and second securing members 304 and 314 of the connector support assembly 300 in the open receiving position, according to an embodiment of the present disclosure. While not shown in FIG. 5, the actuator continues to engage the second securing member 314 to ensure that it is spread away from the first securing member 304. The mating connector 210 is then positioned between the first and second securing members 304 and 314, such as on a support surface of a shell chamber of the first securing member 304. After the mating connector 210 is positioned between the first and second securing members 304 and 314, the actuator 114 (shown in FIG. 2) disengages the second securing member 314. As the actuator 114 releases from the second securing member 314, the springs (which may be compressed between the end wall 308 and the second securing member 314, and/or coupled to the bearings 316) expand, thereby moving the second securing member 314 toward the first securing member 304 and clamping the mating connector 210 therebetween.

Figure 6:
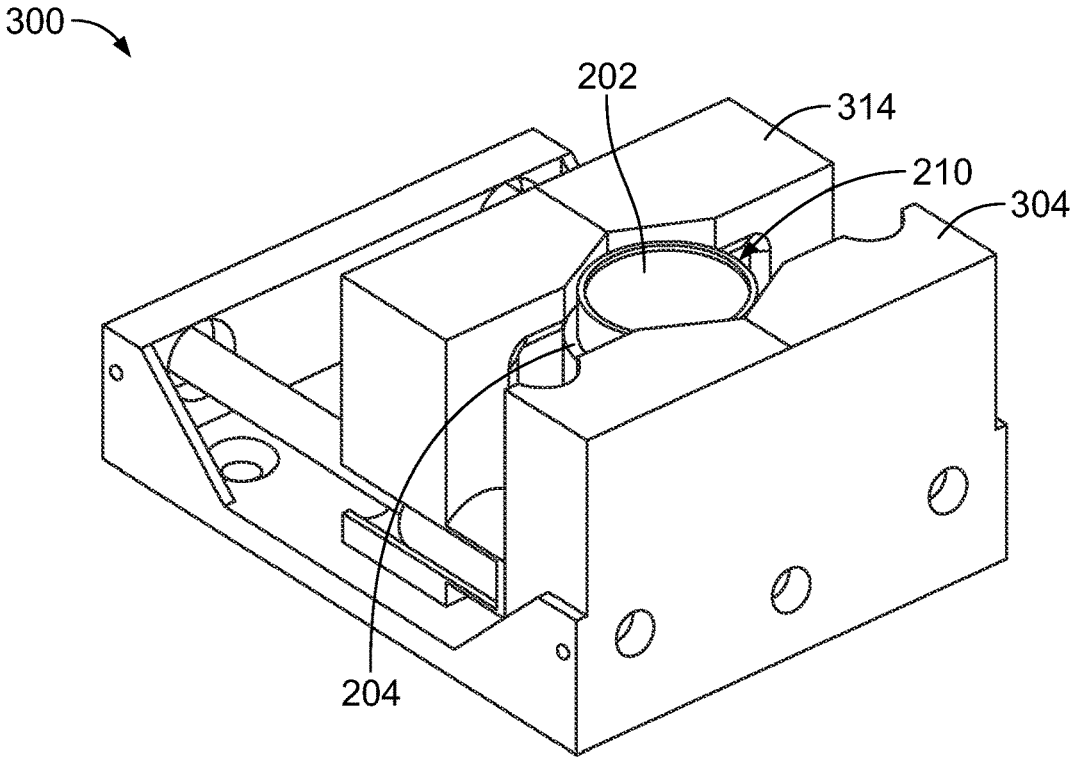
FIG. 6 illustrates a perspective top view of a connector support assembly in a clamped position in which a mating connector is securely clamped between opposed securing members, according to an embodiment of the present disclosure.

FIG. 6 illustrates a perspective top view of the connector support assembly 300 in a clamped position in which the mating connector 210 is securely clamped between the opposed first and second securing members 304 and 314, according to an embodiment of the present disclosure. As shown, the grommet 202 may be clamped between the recessed walls 324 and 336 of the respective first and second securing members 304 and 314, while the shell 204 is clamped between the opposed shell chambers of the first and second securing members 304 and 314. The recessed walls 324 and 336 and the opposed shell chambers may be sized and shaped to accommodate cylindrical or tubular shaped mating connectors 210 of various shapes and sizes. The connector support assembly 300 includes at least one actuatable securing member (for example, the second securing member 314) that is configured to be moved between open and closed positions in order to receive a mating connector between the first and second securing members 304 and 314 and securely clamp the mating connector therebetween. Accordingly, the connector support assembly 300 provides a universal connector support assembly 300 that is able to accommodate various different types of mating connectors having various shapes and sizes.

Figure 7:
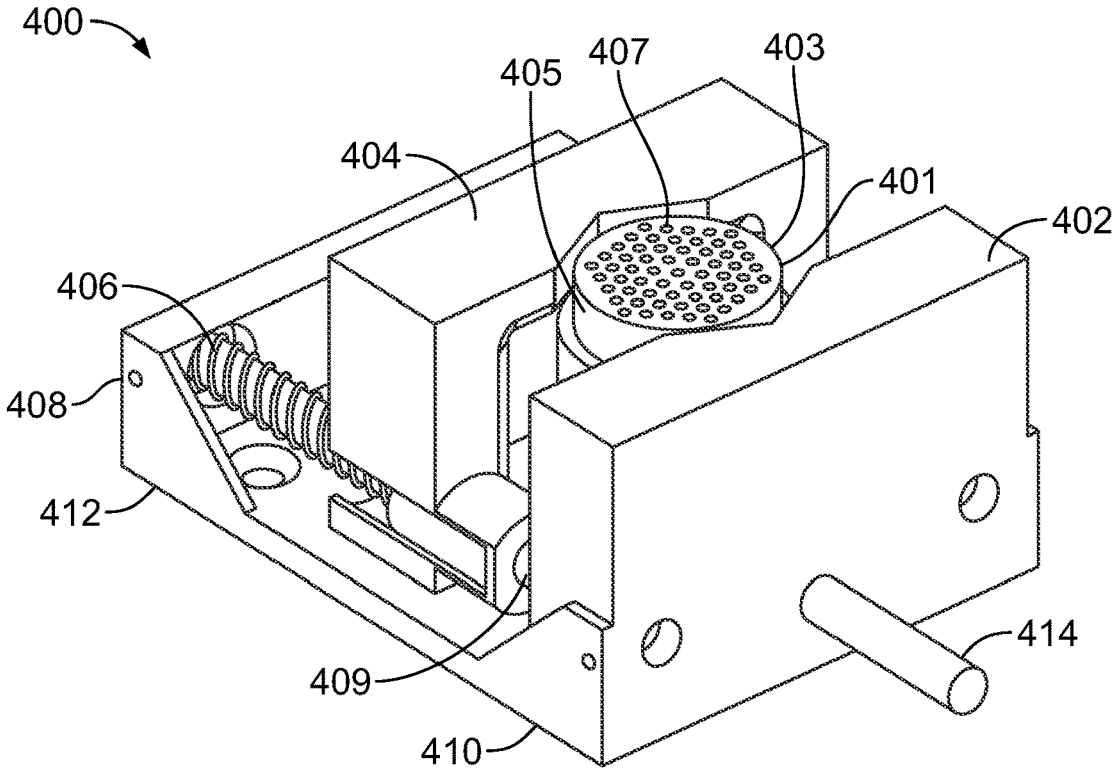
FIG. 7 illustrates a perspective top view of a connector support assembly in a clamped position in which a mating connector is securely clamped between opposed securing members, according to an embodiment of the present disclosure.

FIG. 7 illustrates a perspective top view of a connector support assembly 400 in a clamped position in which a mating connector 401 is securely clamped between opposed securing members 402 and 404, according to an embodiment of the present disclosure. The mating connector 401 includes a grommet 403 and a shell 405. The grommet 403 includes a plurality of holes 407 configured to receive conductive wires. Springs 406 may be positioned around rails 409 between an end wall 408 and the securing member 404. The springs 406 bias the securing member 404 toward the securing member 402, thereby clamping the mating connector 401 therebetween, as described above. As shown, a pallet 410 may support a base 412 of the connector support assembly 400.

A rod 414 may be slidably positioned within a hole of the securing member 402 and operatively couple to the securing member 404. The rod 414 may be operatively engaged by the actuator 114 (shown in FIG. 2). For example, instead of the actuator 114 having a piston, the actuator 114 may alternatively include a channel that receives an end of the rod 414 and engages the rod 414 to actuate the securing member 404 between open and closed position, as described above.

Figure 8:
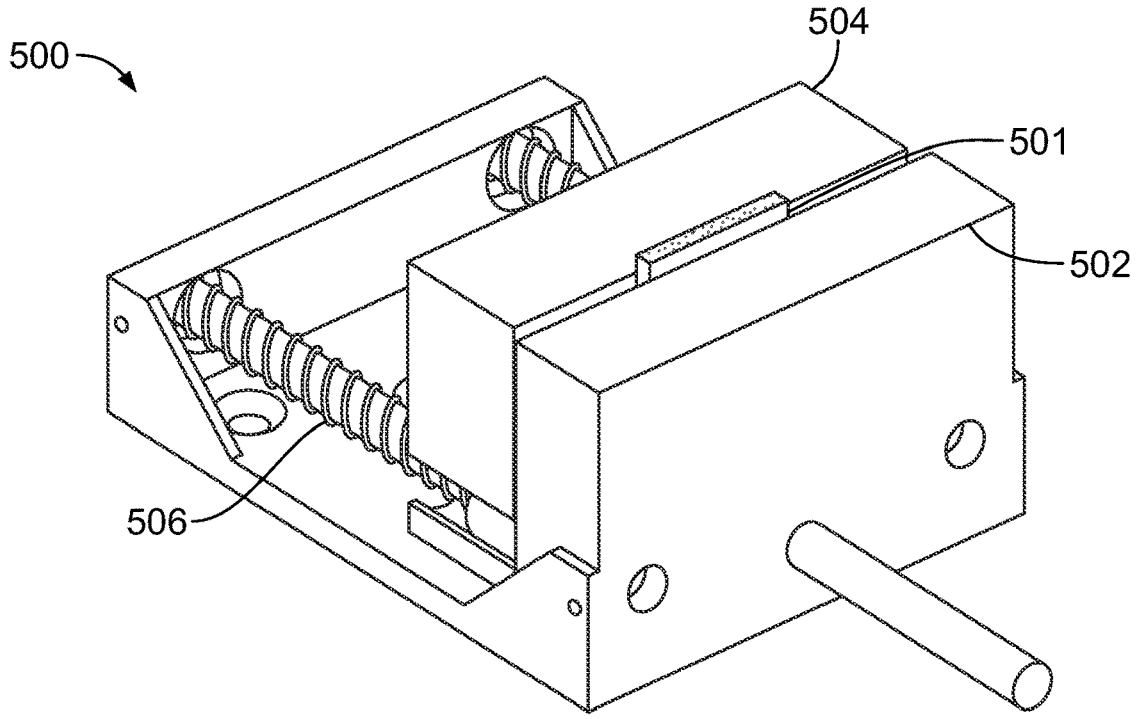
FIG. 8 illustrates a perspective top view of a connector support assembly in a clamped position in which a mating connector is securely clamped between opposed securing members, according to an embodiment of the present disclosure.

FIG. 8 illustrates a perspective top view of a connector support assembly 500 in a clamped position in which a mating connector 501 is securely clamped between opposed securing members 502 and 504, according to an embodiment of the present disclosure. The mating connector 501 may have a perimeter with flat surfaces. Accordingly, connector interface surfaces of the securing members 502 and 504 may be flat. Springs 506 positioned around at least one rail may bias the securing member 504 toward the securing member 502.

Figure 9:
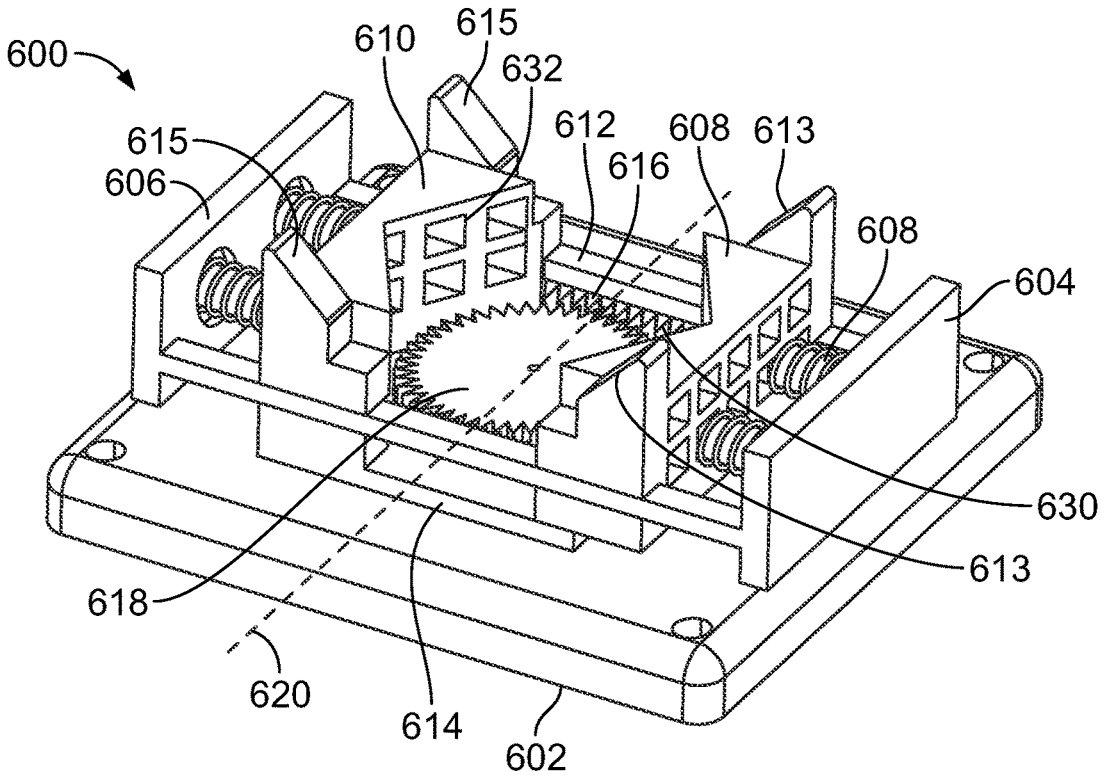
FIG. 9 illustrates a perspective top view of a connector support assembly in an open position, according to an embodiment of the present disclosure.

FIG. 9 illustrates a perspective top view of a connector support assembly 600 in an open position, according to an embodiment of the present disclosure. The connector support assembly 600 is an example of the connector support assembly 210 shown in FIG. 2. The connector support assembly 600 includes a base 602. Fixed opposed end walls 604 and 606 upwardly extend from the base 602. Rails 606 extend between the end walls 604 and 606. Opposed first and second securing members 608 and 610 are slidably retained on the rails 606. Each of the securing members 608 and 610 includes a rack 612 and 614 having a toothed interface 616 that engages a central pinion gear 618 rotatably secured on an upper surface of the base 602. Each of the first and second securing members 608 and 610 may be spring-biased toward one another.

An end effector of the engaging robot 104 (shown in FIG. 1) may provide an actuator that spreads the first and second securing members 608 and 610 apart from one another. Each of the securing members 608 and 610 may include lateral ramped peaks 613 and 615 that are configured to be engaged by the end effector. In this manner, a separate and distinct actuator may not be used. As the first and second securing members 608 and 610 are moved in relation to one another, the racks 612 and 614 engage the pinion gear 618 to provide controlled movement between the first and second securing members 608 and 610 that ensure that both are equally spaced from a central lateral axis 620 of the connector support assembly 600. Alternatively, the connector support assembly 600 may not include the racks and pinion gear.

As shown, interior connector interface walls 630 and 632 of the first and second securing members 608 and 610 may be angled, such as V-shaped, in order to accommodate cylindrical mating connectors of various sizes. Optionally, the interior connector interface walls 630 and 632 may be various other shapes and sizes, such as flat, curved, and/or the like.

Figure 10:
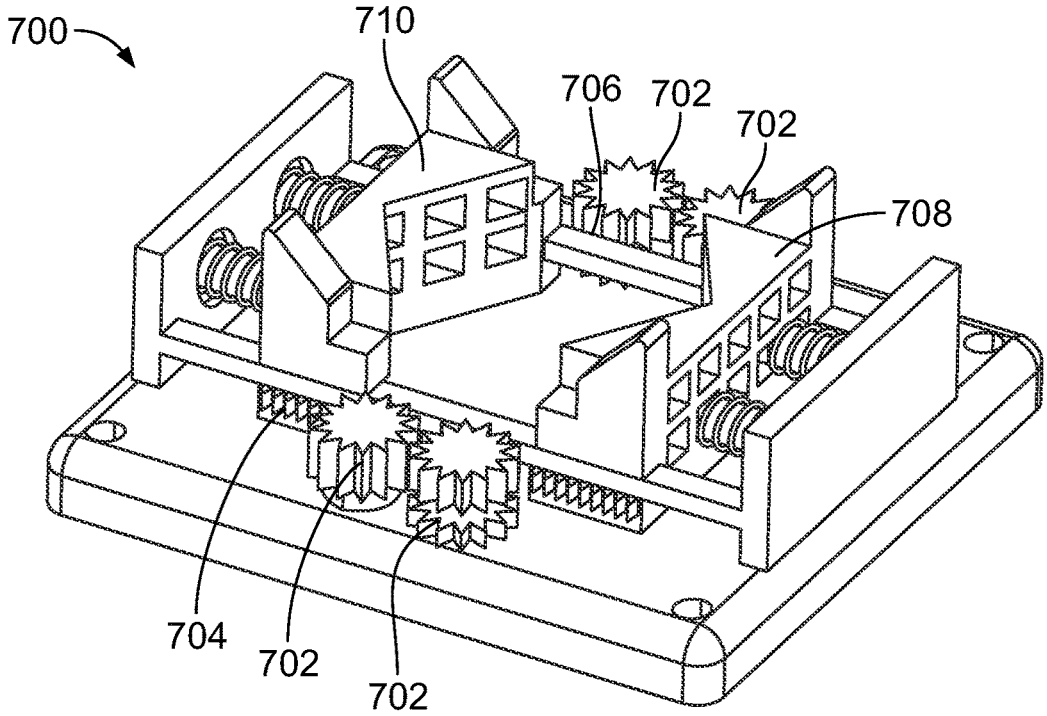
FIG. 10 illustrates a perspective top view of a connector support assembly in an open position, according to an embodiment of the present disclosure.

FIG. 10 illustrates a perspective top view of a connector support assembly 700 in an open position, according to an embodiment of the present disclosure. The connector support assembly 700 is an example of the connector support assembly 210 shown in FIG. 2. The connector support assembly 700 is similar to the assembly 600, except, instead of an interior pinion gear, outer pinion gears 702 engage outwardly-directed racks 704 and 706 of the first and second securing members 708 and 710. By disposing the pinion gears 702 outside of an area between the first and second securing members 708 and 710, larger mating connectors may be accommodated as there is no pinion gear underneath the mating connector when it is clamped between the first and second securing members 708 and 710.

Figure 11:
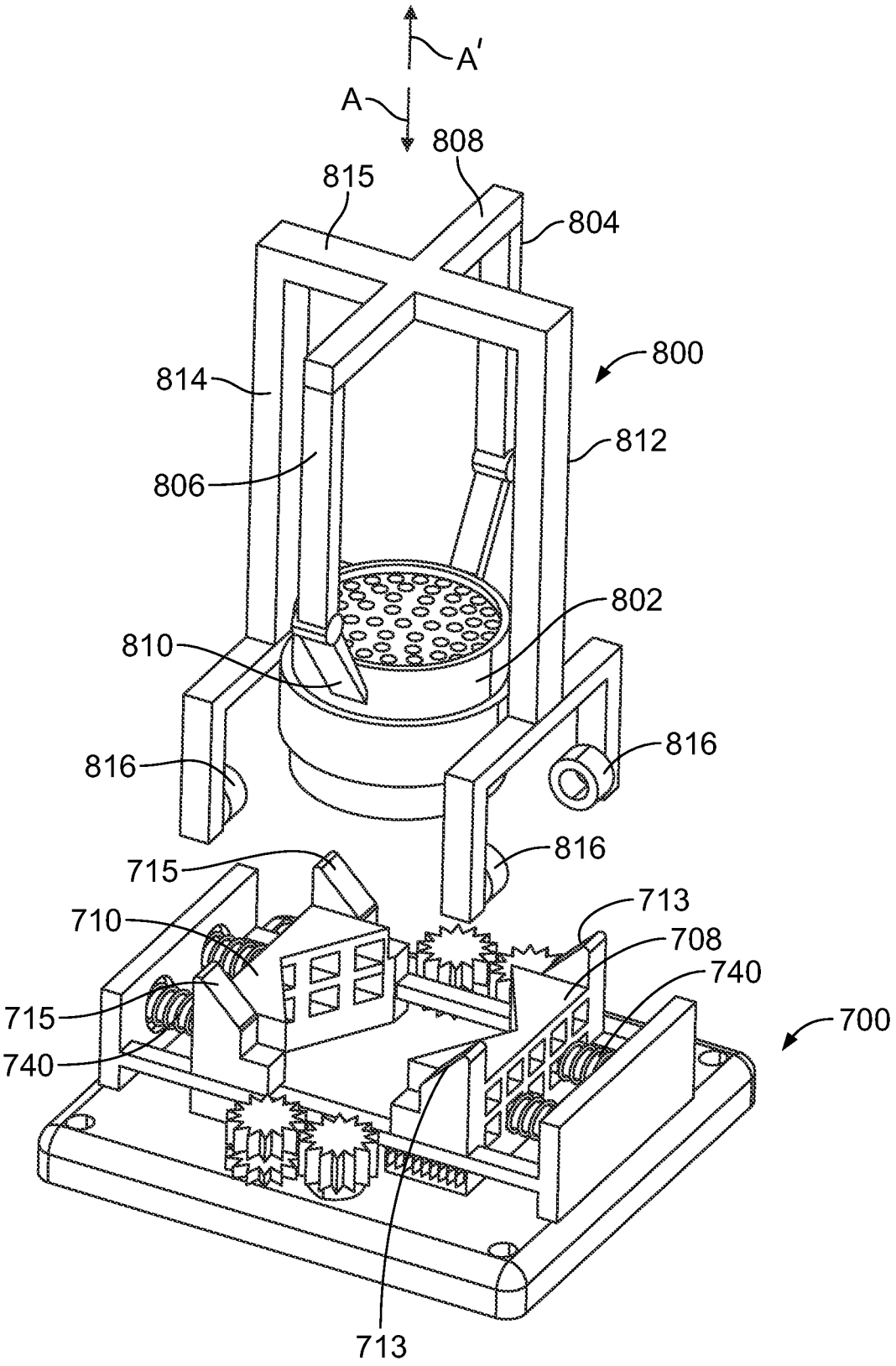
FIG. 11 illustrates a perspective top view of an end effector of an engaging robot positioned above a connector support assembly, according to an embodiment of the present disclosure.

FIG. 11 illustrates a perspective top view of an end effector 800 of an engaging robot positioned above the connector support assembly 700, according to an embodiment of the present disclosure. While shown with the connector support assembly 700, the end effector 800 may also be used with the connector support assembly 600 shown in FIG. 9. The end effector 800 is configured to grasp a mating connector 802 and actuate the first and second securing members 708 and 710 into an open position.

The end effector 800 includes opposed connector retaining beams 804 and 806 extending from an upper cross beam 808. Distal tips 810 of the retaining beams 804 and 806 grasp the mating connector 802, similar to forceps. Actuating beams 812 and 814 extend downwardly from an upper cross beam 815 that perpendicularly connects to the cross beam 808. Each actuating beam 812 and 814 includes opposed rollers 816 that are aligned over a respective ramped peak 713 or 715 of a securing member 708 or 710.

In order to actuate the first and second securing members 608 and 610 into an open position, the end effector 800 is urged toward the connector support assembly 700 in the direction of arrow A. As the end effector 800 is urged in the direction of arrow A, the rollers 816 engage the ramped peaks 713 and 715. With continued urging in the direction of arrow A, the rollers 816 roll on the ramped peaks 713 and 715 and the actuating beams 812 and 814 spread the first and second securing members 708 and 710 apart. Accordingly, the retaining beams 804 and 806 may release the mating connector 802. As the end effector 800 is then lifted in the direction of arrow A' so that the rollers 816 no longer contact the ramped peaks 713 and 715, the springs 740 bias the first and second securing members 708 and 710 toward one another, thereby clamping the mating connector 802 therebetween.

Figure 12:
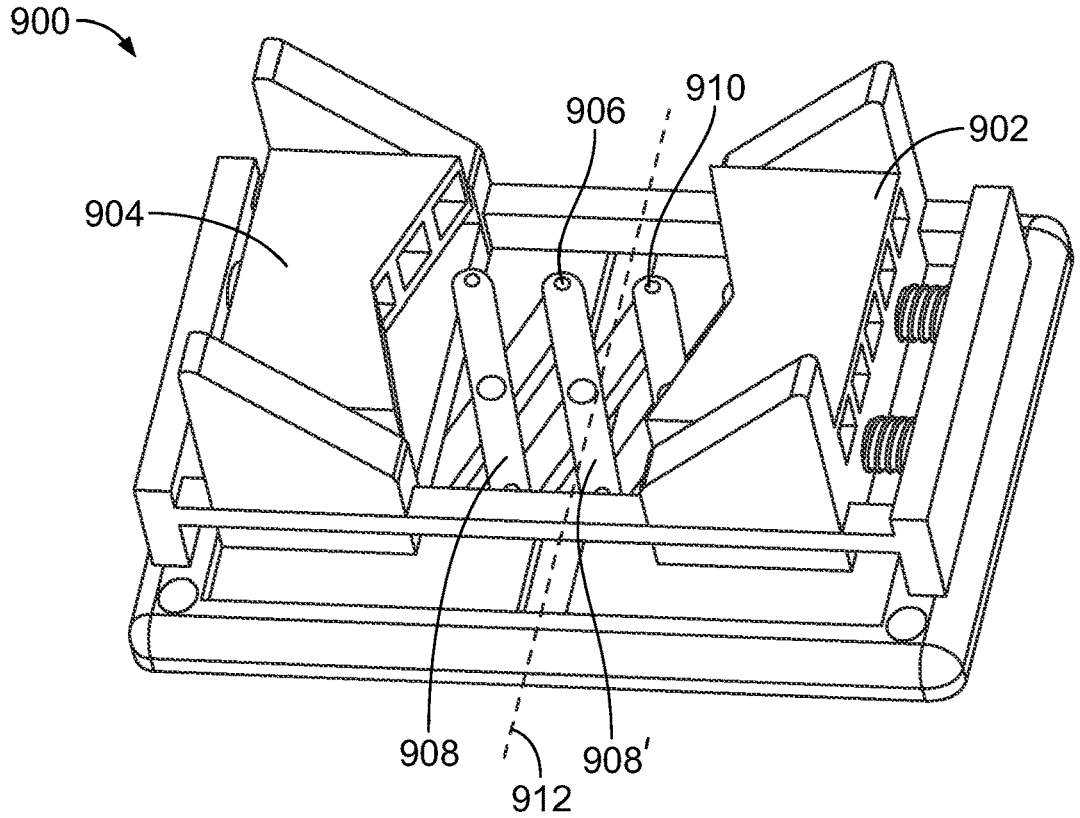
FIG. 12 illustrates a perspective top view of a connector support assembly in an open position, according to an embodiment of the present disclosure.

FIG. 12 illustrates a perspective top view of a connector support assembly in an open position, according to an embodiment of the present disclosure. The connector support assembly 900 is an example of the connector support assembly 210 shown in FIG. 2. The connector assembly 900 is similar to the connector assembly 600 shown in FIG. 9. Instead of a rack and pinion, however, the first and second securing members 902 and 904 are movably connected together through a scissor link 906, which may include a plurality of planar flat beams 908 pivotally connected to one another. A center beam 908' is secured to a central track 910, such as through a center pin, which ensures that the scissor link 906 remains centered about a central lateral axis 912. As such, the first and second securing members 902 and 904 are spaced the same distance from the central lateral axis 912 between open and closed positions. The scissor link 906 ensures that the first and second securing members 902 and 904 are symmetrically centered in relation to the central lateral axis 912. Alternatively, the scissor link 906 may not be secured to the central track 910. The first and second securing members 902 and 904 may be spread open through operation of an end effector and/or a separate and distinct actuator, as described above.

Figure 13:
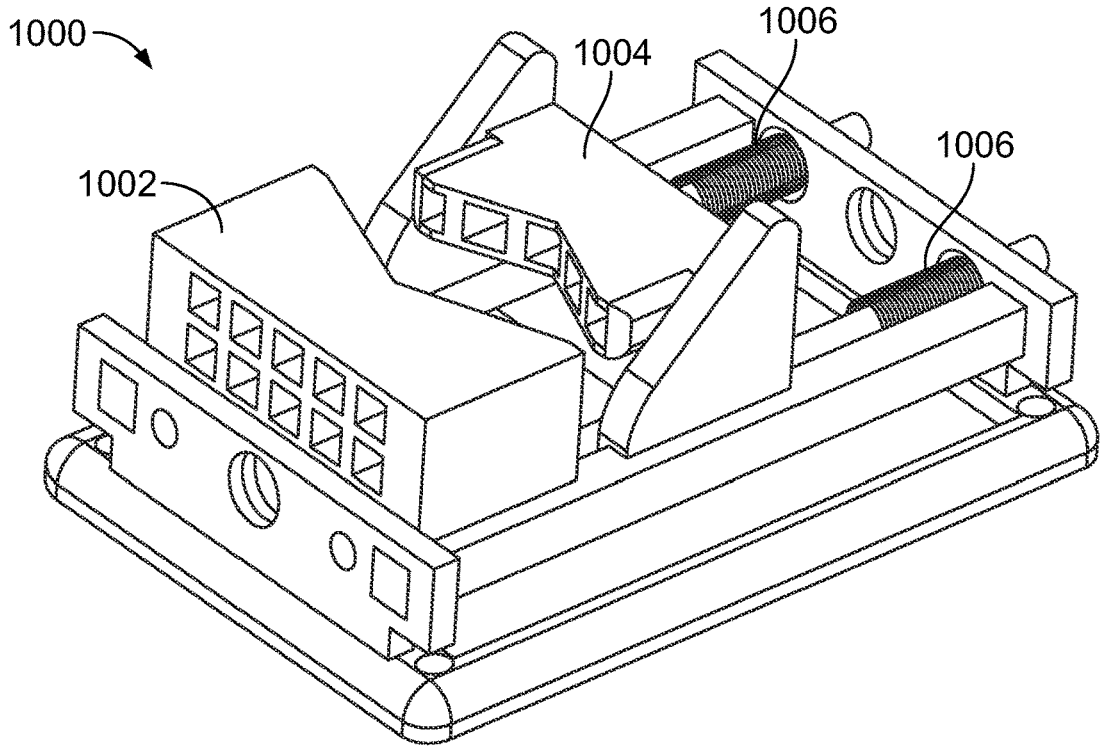
FIG. 13 illustrates a perspective top view of a connector support assembly in a closed position, according to an embodiment of the present disclosure.

FIG. 13 illustrates a perspective top view of a connector support assembly 1000 in a closed position, according to an embodiment of the present disclosure. The connector support assembly 1000 is an example of the connector support assembly 210 shown in FIG. 2. The connector support assembly 1000 includes a fixed securing member 1002 at one end and a moveable securing member 1004 that is configured to be actuated away from the securing member 1002. The securing member 1004 may be spring-biased toward the securing member 1002 through one or more springs 1006, as described above. The securing member 1004 may be spread open through operation of an end effector and/or a separate and distinct actuator, as described above.

Figure 14:
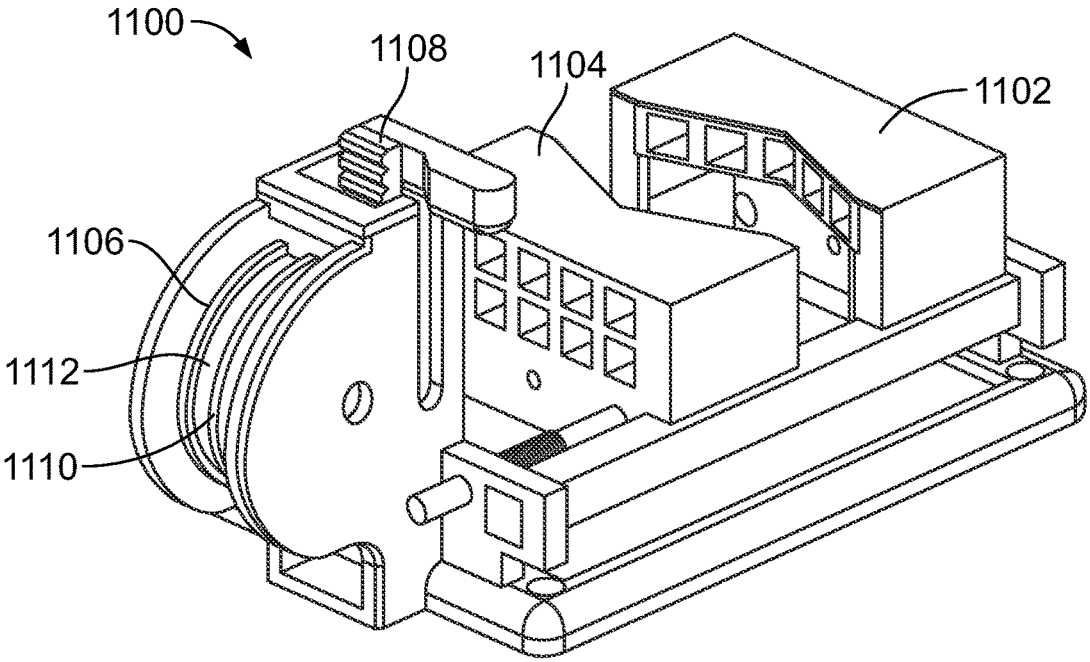
FIG. 14 illustrates a perspective top view of a connector support assembly a closed position, according to an embodiment of the present disclosure.
Figure 15:
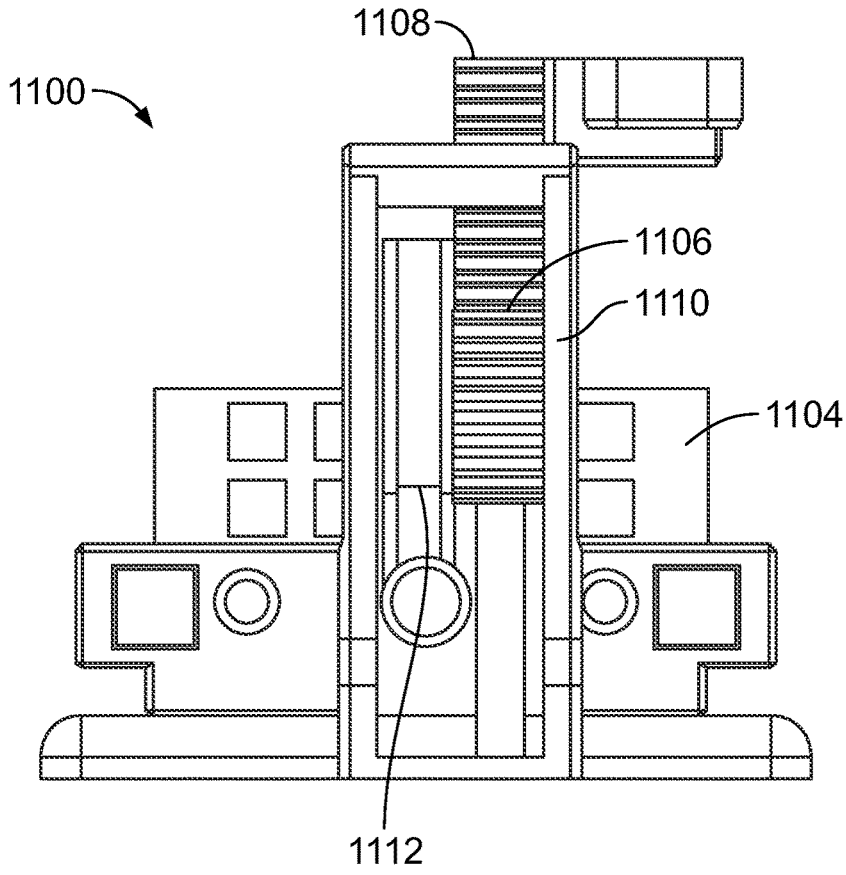
FIG. 15 illustrates an end view of a connector support assembly, according to an embodiment of the present disclosure.

FIG. 14 illustrates a perspective top view of a connector support assembly 1100 a closed position, according to an embodiment of the present disclosure. FIG. 15 illustrates an end view of the connector support assembly 1100. Referring to FIGS. 14 and 15, the connector support assembly 1100 is an example of the connector support assembly 210 shown in FIG. 2. The connector support assembly 1100 includes a fixed securing member 1102 at one end, and a moveable securing member 1104 operatively connected to a cam gear 1106.

The cam gear 1106 may include a rack 1108 and pinion gear 1110 attached to a cam 1112, which is operatively connected to the securing member 1104 through a link, such as a wire, rod, beam, and/or the like. As an actuator or an end effector depresses a rack tab 1114 that is operatively connected to the rack 1108, the pinion gear 1110 is rotated along with the cam 1112. The rotation of the cam 1112 along with the smaller diameter pinion gear 1110 drives the link, such as by coiling a wire up around the cam 1112, and pulls the securing member 1104 away from the securing member 1102 into an open position. As the end effector releases from the rack tab 1114, spring force biases the securing member 1004 back toward the securing member 1102.

Figure 16:
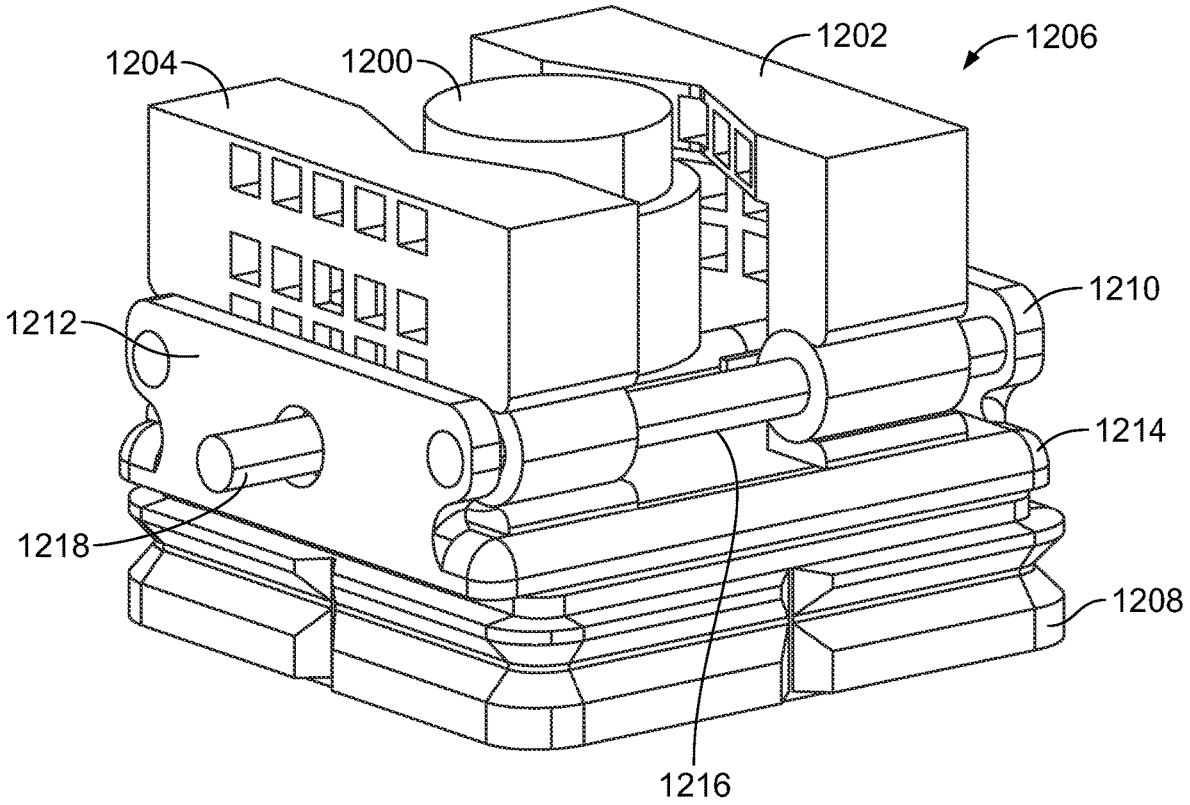
FIG. 16 illustrates a perspective front view of a mating connector securely clamped between opposed securing members of a connector support assembly, according to an embodiment of the present disclosure.

FIG. 16 illustrates a perspective front view of a mating connector 1200 securely clamped between opposed securing members 1202 and 1204 of a connector support assembly 1206, according to an embodiment of the present disclosure. The connector support assembly 1206 is shown supported on a pallet 1208. The connector support assembly 1200 is an example of the connector support assembly 210 shown in FIG. 2.

The connector support assembly 1206 includes two fixed end walls 1210 and 1212 upwardly extending from a base 1214. Rails 1216 extend between the end walls 1210 and 1212. The securing member 1202 may be fixed in position. The securing member 1204 may be moveable. For example, the securing member 1202 may be operatively connected to a rod 1218 that is configured to be engaged by an actuator. Optionally, the securing member 1202 may be the moveable member, while the securing member 1204 is fixed in position. In this embodiment, the rod 1218 may be operatively connected to the securing member 1202. The securing members 1202 and 1204 may or may not be spring-biased toward one another.

Figure 17:
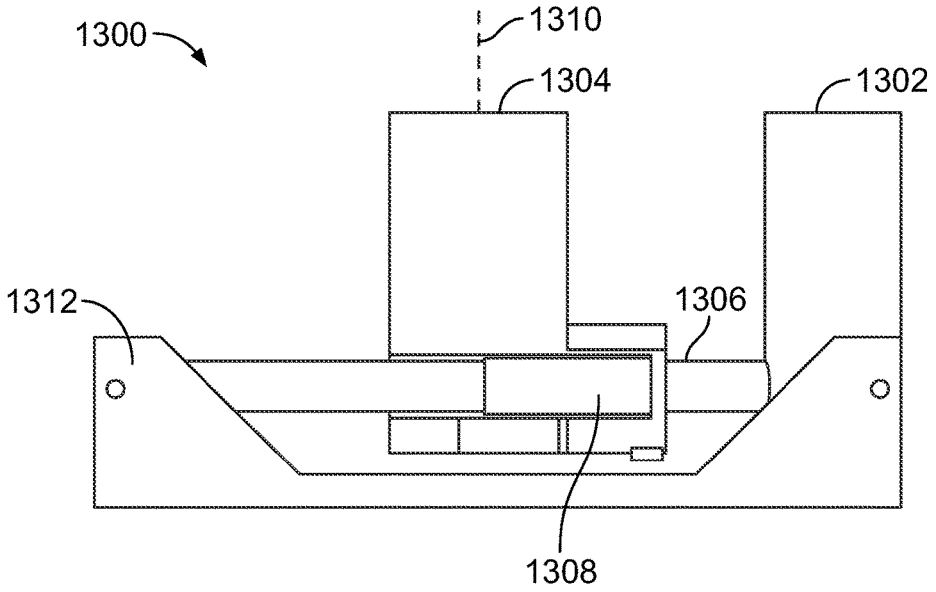
FIG. 17 illustrates a lateral view of a connector support assembly, according to an embodiment of the present disclosure.

FIG. 17 illustrates a lateral view of a connector support assembly 1300, according to an embodiment of the present disclosure. The connector support assembly 1300 is an example of the connector support assembly 210 shown in FIG. 2. The connector support assembly 1300 is similar to the connector support assembly 300 shown in FIGS. 3-6. As shown, the connector support assembly 1300 may include a fixed securing member 1302 and a moveable securing member 1304 slidably secured on rails 1306. The securing member 1304 may include bearings 1308, each of which may slidably secure around an outer surface of a rail 1306. As shown, the bearings 1308 may be offset from a central plane 1310 of the securing member 1304. The bearings 1308 may extend below and in front of an interior face of the securing member 1304.

The inward offset of the bearings 1308 provides extra clearance for spring compression. That is, the inward offset of the bearings 1308 allows the moving securing member 1304 to move further towards the end wall 1312 against a fully compressed spring. The additional clearance area allows the connector support assembly 1300 to be able to accommodate large diameter mating connectors. The offset bearings 1308 may be used with respect to any of the embodiments described in the present application in which a securing member is slidably mounted on one or more rails. Alternatively, the bearings may not be offset.

Figure 18:
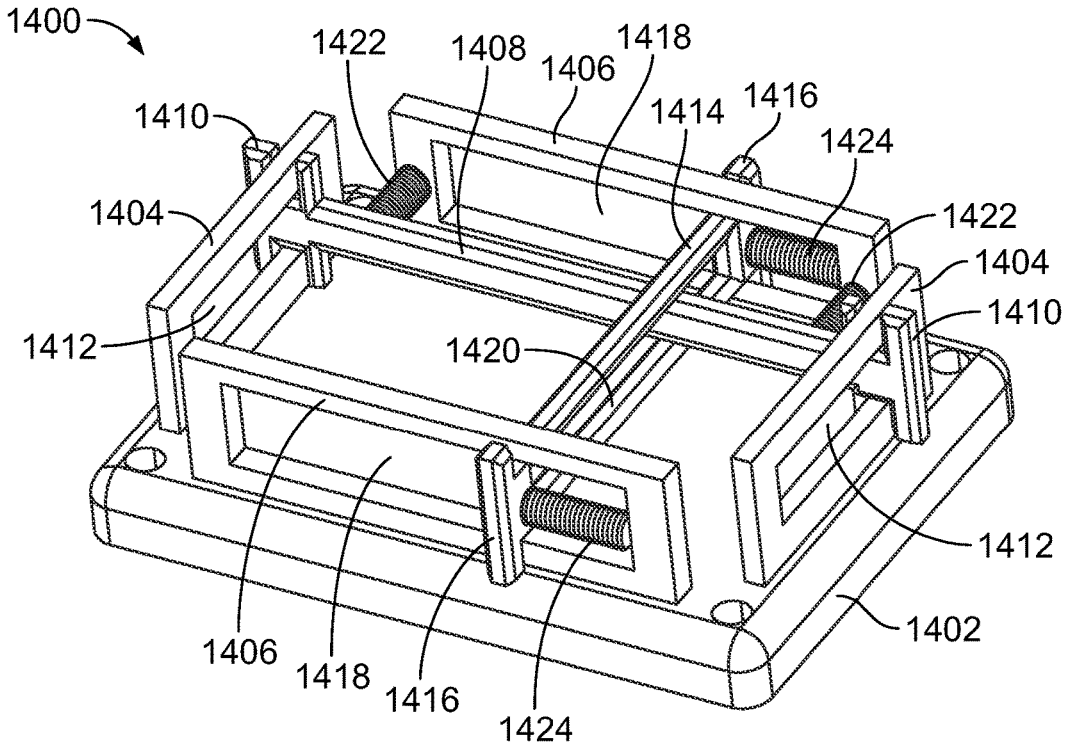
FIG. 18 illustrates a perspective top view of a connector support assembly in an open position, according to an embodiment of the present disclosure.

FIG. 18 illustrates a perspective top view of a connector support assembly 1400 in an open position, according to an embodiment of the present disclosure. The connector support assembly 1400 is an example of the connector support assembly 210 shown in FIG. 2. The connector support assembly 1400 may be used to securely clamp around a portion of a linear connector having flat surfaces, for example.

The connector support assembly 1400 includes a base 1402. Opposed end brackets 1404 extend upwardly from the base 1402. Opposed side brackets 1406 also extend upwardly from the base 1402. A first securing member 1408 (such as a securing rail, wall, or fence) is moveably secured to the end brackets 1404. For example, end beams 1410 are slidably retained with respect to channels 1412 formed through the brackets 1404. Similarly, a second securing member 1414 is moveably secured to the side brackets 1406. For example, side beams 1416 are slidably retained with respect to channels 1418 formed through the side brackets 1406. A channel 1420 may be formed through the second securing member 1414, which allows the first securing member 1408 to pass through the second securing member 1414 and slide therethrough.

Springs 1422 may be secured between a side wall 1406 and the first securing member 1408. The springs 1422 bias the first securing member 1408 toward the opposite side wall 1406. Similarly, springs 1424 may be secured between an interior of each side wall 1406 and the second securing member 1414. The springs 1424 bias the second securing member 1414 toward an end bracket 1404.

An actuator and/or an end effector is configured to actuate the first and second securing members 1408 and 1414 into an open position as shown in FIG. 18. For example, the actuator and/or end effector may engage the end beams 1410 and/or the side beams 1416 to open the first and second securing members 1408 and 1414. A mating connector is positioned between the first and second securing members 1408 and 1414 and an end bracket 1404 and a side wall 1406 opposite from the springs 1422 and 1424. After the mating connector is positioned within the connector support assembly 1400, the first and second securing members 1408 and 1414 are released. As such, the springs 1422 and 1424 bias the first and second securing members 1408 and 1414 into a clamping position around a portion of the mating connector. As shown in FIG. 18, the mating connector is configured to be clamped in a lower left corner of the connector support assembly 1400. The fixed end and side walls 1404 and 1406 provide a stable surface into which the mating connector is urged, while the securing members 1408 and 1404 are biased into the mating connector and balanced by spring force.

Figure 19:
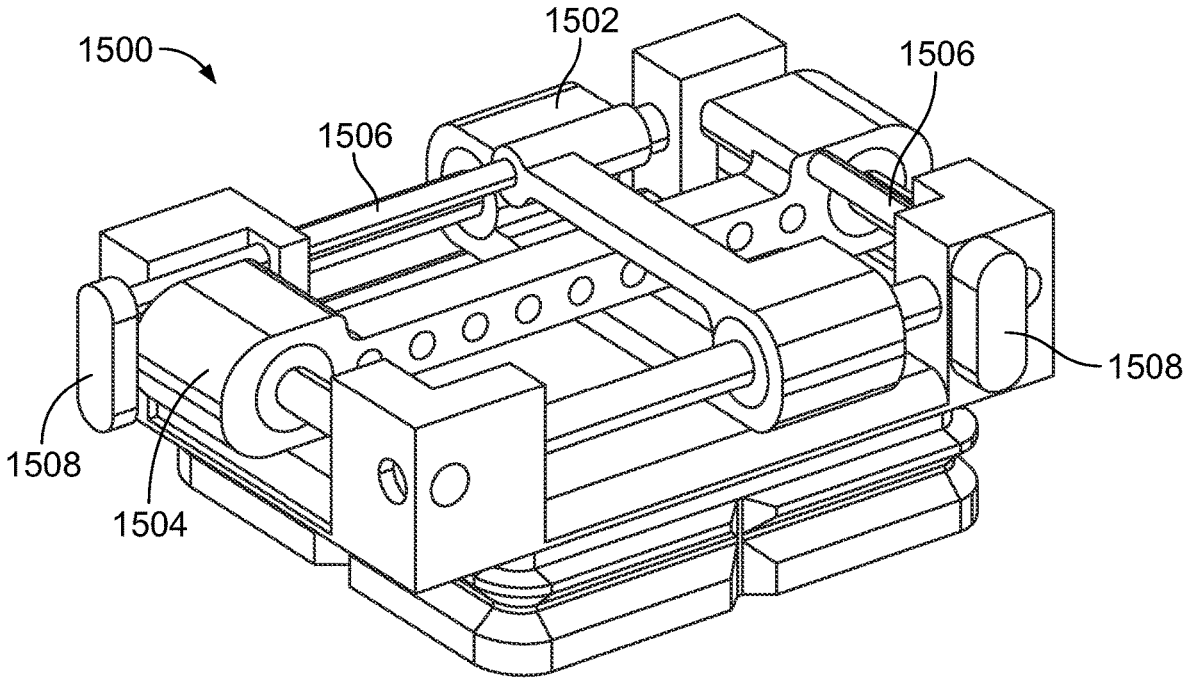
FIG. 19 illustrates a perspective top view of a connector support assembly in an open position, according to an embodiment of the present disclosure.

FIG. 19 illustrates a perspective top view of a connector support assembly 1500 in an open position, according to an embodiment of the present disclosure. The connector support assembly 1500 is an example of the connector support assembly 210 shown in FIG. 2. The connector support assembly 1500 is similar to the connector support assembly 1400 shown in FIG. 18. Each of the first and second securing members 1502 and 1504 may be operatively coupled to a push rod 1506 having engagement tabs 1508. The push rods 1506 may be engaged by an actuator to move the first and second securing members 1502 and 1504 into an open position.

Figure 20:
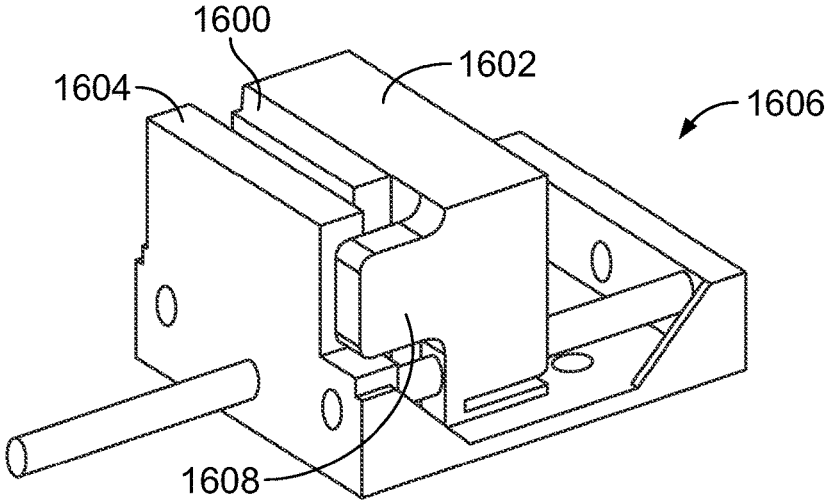
FIG. 20 illustrates a perspective front view of a mating connector securely clamped between opposed securing members of a connector support assembly, according to an embodiment of the present disclosure.

FIG. 20 illustrates a perspective front view of a mating connector 1600 securely clamped between opposed securing members 1602 and 1604 of a connector support assembly 1606, according to an embodiment of the present disclosure. The connector support assembly 1600 is an example of the connector support assembly 210 shown in FIG. 2. One or both of the securing members 1602 may include lateral protuberances 1608 (such as tabs), which provide a restraining wall for the mating connector 1600. That is, the lateral protuberances 1608 provide a barrier past which the mating connector 1600 cannot pass, thereby ensuring that the mating connector 1600 does not laterally dislodge from the connector support assembly 1606. The lateral protuberances may be used with respect various embodiments of the present disclosure, such as those shown in FIGS. 3-17.

Figure 21:
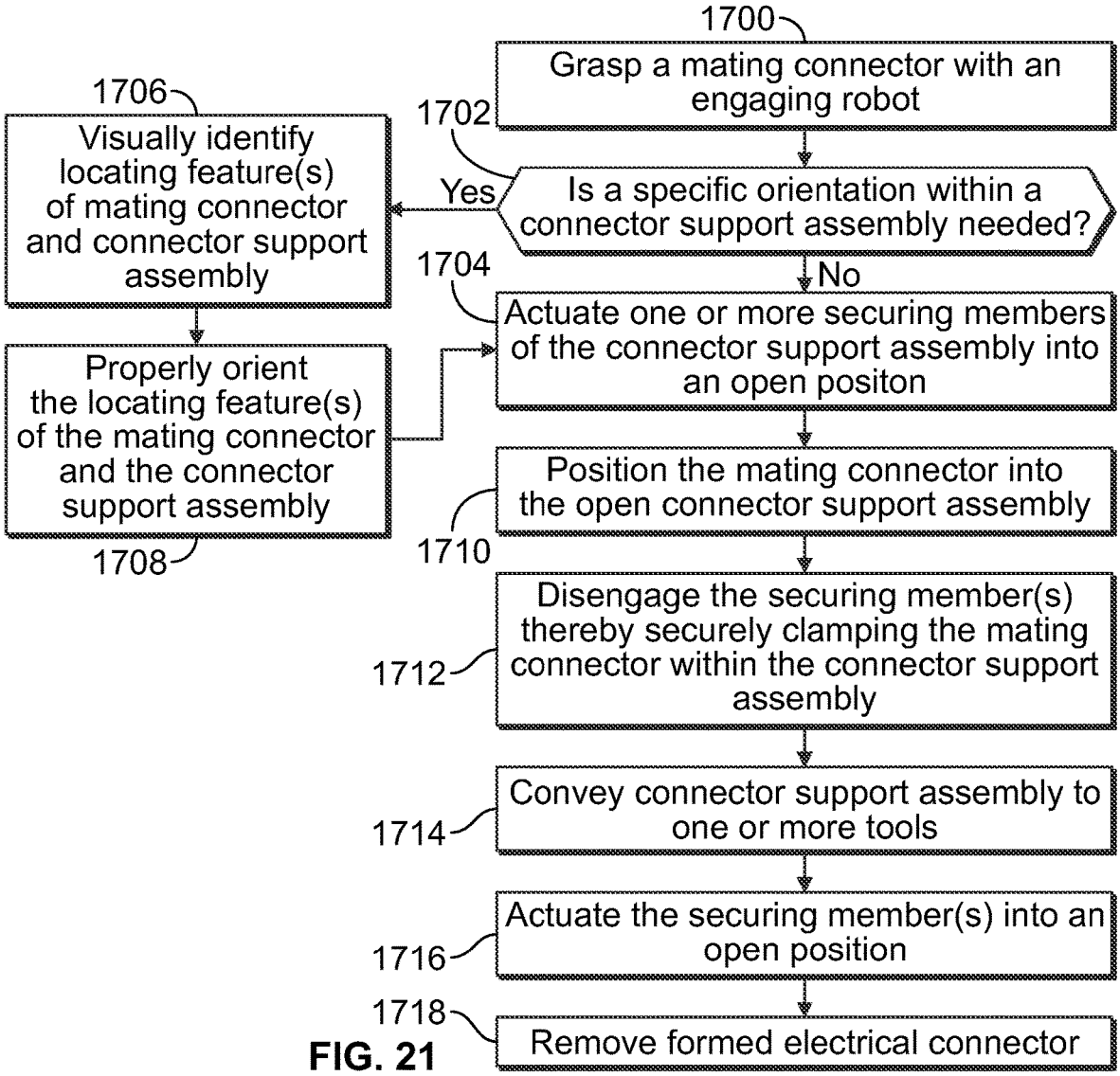
FIG. 21 illustrates a flow chart of a method of manufacturing an electrical connector, according to an embodiment of the present disclosure.

FIG. 21 illustrates a flow chart of a method of manufacturing an electrical connector, according to an embodiment of the present disclosure. At 1700, a mating connector is grasped and retained by an engaging robot. At 1702, it is determined if a specific orientation of the mating connector within a connector support assembly is needed during the manufacturing process. If not, the process proceeds to 1704, in which one or more securing members of the connection support assembly are actuated into an open position. If, however, a specific orientation is needed, the method proceeds from 1702 to 1706, in which one or more locating features of the mating connector and one or more locating features of the connector support assembly are visually identified, such as through a feature recognition system.

Then, at 1708, the mating connector is properly aligned with the connector support assembly based on a proper orientation of the locating feature(s) of the mating connector in relation to the locating feature(s) of the connector support assembly. The method then proceeds from 1708 to 1704.

After the securing member(s) are actuated into the open position at 1704, the mating connector is positioned in the open connector support assembly at 1710. Then, at 1712, the securing member(s) is disengaged to securely clamp the mating connector within the connector support assembly. For example, as the securing member(s) is disengaged, the securing member(s) may be spring-biased into a clamping position. After the mating connector is securely clamped in place within the connector support assembly, the connector support assembly is conveyed to one or more automated tools at 1716, which affix or otherwise secured components to the mating connector to form an electrical connector. After the electrical connector is formed, the securing member(s) is actuated into an open position at 1716. Then, at 1718, the formed electrical connector is removed from the connector support assembly.

The control unit 150 of FIG. 1 may be used to control operation of the method shown and described with respect to FIG. 21. The control unit 150 may be in communication with the engaging robots 104 and 132, automated tools 120, 122, and 124, RFID readers 116, actuators 110, and the like. The control unit 150 may be programmed to operate the system 100 according to the method shown and described with respect to FIG. 21.

As used herein, the term "control unit," "unit," "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms.

The control unit 150, for example, is configured to execute a set of instructions that are stored in one or more storage elements (such as one or more memories), in order to process data. For example, the control unit 150 may include or be coupled to one or more memories. The storage elements may also store data or other information as desired or needed. The storage elements may be in the form of an information source or a physical memory element within a processing machine.

The set of instructions may include various commands that instruct the control unit 150 as a processing machine to perform specific operations such as the methods and processes of the various embodiments of the subject matter described herein. The set of instructions may be in the form of a software program. The software may be in various forms such as system software or application software. Further, the software may be in the form of a collection of separate programs or modules, a program module within a larger program or a portion of a program module. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as the control unit 150 shown in FIG. 1. It is to be understood that the processing or control units may represent circuit modules that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the control units may represent processing circuitry such as one or more of a field programmable gate array (FPGA), application specific integrated circuit (ASIC), microprocessor(s), a quantum computing device, and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

Referring to FIGS. 1-21, embodiments of the present disclosure provide efficient systems and methods of forming a device, such as an electrical connector. Embodiments of the present disclosure provide connector support assemblies that are configured to adapt to and securely retain a wide variety of mating connector types, which may vary in size and shape. The connector support assemblies may include one or more securing members that are configured to be moved between open and closed positions in order to accommodate mating connectors of various shapes and sizes. Embodiments of the present disclosure provide systems and methods that reduce manufacturing time as mating connectors are not manually secured to a fixed pedestal of a connector support. Instead, the connector support assemblies of the present disclosure are adaptable to various shapes and sizes, and, as such, automated, robotic systems may be used to insert and remove the mating connectors.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A connector support assembly configured to securely retain an electrical connector during a manufacturing process, the connector support assembly comprising:

a base;

a first securing member; and a second securing member, wherein one or both of the first and second securing members is movable, wherein one or both of the first and second securing members is movable between an open position in which a mating connector of the electrical connector is positioned between the first and second securing members, and a clamped position in which the mating connector is securely clamped between the first and second securing members, wherein the first and second securing members are configured to receive the electrical connector from an engaging robot, and wherein one or both of the first and second securing members is configured to be engaged by an end effector of the engaging robot to move one or both of the first and second securing members into the open position.

2. The connector support assembly of claim 1, wherein the first securing member or the second securing member is fixed in position with respect to the base, and wherein the other of the first securing member or the second securing member is moveable.

3. The connector support assembly of claim 1, wherein one or both of the first and second securing members is spring-biased towards a closed position.

4. The connector support assembly of claim 1, wherein one or both of the first and second securing members is configured to be engaged by an actuator to move one or both of the first and second securing members into the open position.

5. The connector support assembly of claim 1, wherein the connector support assembly is configured to securely retain a variety of mating connectors that differ in one or both of size or shape.

6. The connector support assembly of claim 1, further comprising:

at least one end wall extending from the base; and at least one rail connected to the end wall, wherein one or both of the first and second securing members is slidably secured on the at least one rail through at least one bearing.

7. The connector support assembly of claim 6, wherein the at least one bearing is offset with respect to one or both of the first and second securing members.

8. The connector support assembly of claim 1, wherein at least one of the first and second securing members comprises:

an outer wall;

lateral walls connected to the outer wall; and a connector interface wall extending between the lateral walls opposite from the outer wall, wherein the connector interface wall is configured to abut into a portion of the mating connector.

9. The connector support assembly of claim 8, wherein the connector interface wall comprises at least one angled surface configured to abut against a portion of the mating connector.

10. The connector support assembly of claim 8, wherein the outer wall includes an actuator opening configured to receive a rod or a portion of an actuator that is configured to be engaged to move one or both of the first and second securing members into the open position.

11. The connector support assembly of claim 8, wherein the connector interface wall comprises a shell chamber that is configured to conform to a portion of an outer surface of the mating connector.

12. The connector support assembly of claim 1, wherein one or both of the securing members comprises one or more of a marking or a protuberance that is configured to be detected by a feature recognition system that is used to orient the mating connector within the connector support assembly.

13. The connector support assembly of claim 1, wherein both of the first and second securing members are moveable.

14. The connector support assembly of claim 13, wherein each of the first and second securing members comprises a rack, wherein at least one pinion gear is rotatably secured to the base, wherein the at least one pinion gear engages the rack of each of the first and second securing members to maintain a symmetrical relationship of the first and second securing members about a central lateral axis.

15. The connector support assembly of claim 13, wherein the first and second securing members are moveably secured together through a scissor link.

16. The connector support assembly of claim 1, wherein one or both of the first and second securing members comprises at least one peaked ramp, and wherein the at least one peaked ramp is configured to be engaged by an end effector to spread one or both of the first and second securing members into the open position.

17. The connector support assembly of claim 1, further comprising a cam gear operatively coupled to one of the first and second securing members, wherein the cam gear comprises:

a rack;

a pinion gear coupled to the rack;

a cam coupled to the pinion gear; and a link connecting the cam to one of the first and second securing members.

18. The connector support assembly of claim 1, further comprising:

opposed end brackets extending from the base, wherein the first securing member is moveably secured between the opposed end brackets; and opposed side brackets extending from the base, wherein the second securing member is moveably secured between the opposed side brackets, and wherein the second securing member comprises a channel through which the first securing member passes and moves.

19. The connector support assembly of claim 1, wherein one or both of the first and second securing members comprises lateral protuberances that are configured to constrain lateral shifting of the mating connector.

20. A system for manufacturing an electrical connector, the system comprising:

a plurality of mating connectors, wherein at least two of the plurality of mating connectors differ in one or both of size and shape;

a first engaging robot having an end effector that is configured to grasp each of the plurality of mating connectors; and a connector support assembly configured to securely retain each of the plurality of the mating connectors, wherein the first engaging robot is configured to position one of the plurality of mating connectors into the connector support assembly, wherein the end effector of the first engaging robot is configured to actuate the connector support assembly into the open position, wherein the connector support assembly comprises:

a base;

a first securing member; and a second securing member, wherein one or both of the first and second securing members is movable, and wherein one or both of the first and second securing members is movable between an open position in which one of the plurality of mating connectors is positioned between the first and second securing members, and a clamped position in which the one of the plurality of mating connectors is securely clamped between the first and second securing members.

21. The system of claim 20, further comprising:

a conveyor configured to convey the connector support assembly; and one or more automated tools connected to the conveyor, wherein the one or more automated tools are configured to secure one or more components to the one of the plurality of mating connectors.

22. The system of claim 21, further comprising a pallet configured to moveably secure the base of the connector support assembly to the conveyor.

23. The system of claim 20, further comprising a second engaging robot configured to remove a fully formed electrical connector from the connector support assembly.

24. The system of claim 20, further comprising an actuator configured to actuate the connector support assembly into the open position.

25. A method for manufacturing an electrical connector, the method comprising:

storing a plurality of mating connectors, wherein at least two of the plurality of mating connectors differ in one or both of size and shape;

grasping one of the plurality of mating connectors with an end effector of a first engaging robot;

moving the one of the plurality of mating connectors with the end effector to a connector support assembly;

actuating one or both of first and second securing members of the connector support assembly into an open position, wherein the actuating comprises actuating the connector support assembly into the position with the end effector of the first engaging robot;

using the end effector to position the one of the plurality of mating connectors between the first and second securing members; and securely clamping the one of the plurality of the mating connectors between the first and second securing members.

26. The method of claim 25, further comprising conveying the connector support assembly to one or more automated tools.

27. The method of claim 26, further comprising:

securing a base of the connector support assembly to a pallet; and moveably securing the pallet to a conveyor.

28. The method of claim 25, further comprising removing a fully formed electrical connector from the connector support assembly with a second engaging robot.

29. The method of claim 25, further wherein the actuating comprises actuating the connector support assembly into the open position with a separate and distinct actuator.

30. The connector support assembly of claim 1, wherein the base is moveably supported on a conveyor.

31. The connector support assembly of claim 30, further comprising a pallet, wherein the base is supported on the pallet, wherein the connector support assembly is conveyed on the conveyor by the pallet.

32. A connector support assembly configured to securely retain an electrical connector during a manufacturing process, the connector support assembly comprising:

a base;

at least one end wall extending from the base;

at least one rail connected to the end wall;

a first securing member; and a second securing member, wherein one or both of the first and second securing members is slidably secured on the at least one rail through at least one bearing, wherein one or both of the first and second securing members is movable between an open position in which a mating connector of the electrical connector is positioned between the first and second securing members, and a clamped position in which the mating connector is securely clamped between the first and second securing members, and wherein the first and second securing members are configured to receive the electrical connector from an engaging robot.

33. The connector support assembly of claim 32, wherein the at least one bearing is offset with respect to one or both of the first and second securing members.

34. A connector support assembly configured to securely retain an electrical connector during a manufacturing process, the connector support assembly comprising:

a base;

a first securing member; and a second securing member, wherein one or both of the first and second securing members is movable, wherein one or both of the first and second securing members is movable between an open position in which a mating connector of the electrical connector is positioned between the first and second securing members, and a clamped position in which the mating connector is securely clamped between the first and second securing members, wherein each of the first and second securing members comprises a rack, wherein at least one pinion gear is rotatably secured to the base, wherein the at least one pinion gear engages the rack of each of the first and second securing members to maintain a symmetrical relationship of the first and second securing members about a central lateral axis, and wherein the first and second securing members are configured to receive the electrical connector from an engaging robot.

35. A connector support assembly configured to securely retain an electrical connector during a manufacturing process, the connector support assembly comprising:

a base;

a first securing member;

a second securing member, wherein one or both of the first and second securing members is movable, wherein one or both of the first and second securing members is movable between an open position in which a mating connector of the electrical connector is positioned between the first and second securing members, and a clamped position in which the mating connector is securely clamped between the first and second securing members; and a cam gear operatively coupled to one of the first and second securing members, wherein the cam gear comprises:

a rack;

a pinion gear coupled to the rack;

a cam coupled to the pinion gear;

a link connecting the cam to one of the first and second securing members, and wherein the first and second securing members are configured to receive the electrical connector from an engaging robot.

36. A connector support assembly configured to securely retain an electrical connector during a manufacturing process, the connector support assembly comprising:

a base;

a first securing member; and a second securing member, wherein one or both of the first and second securing members is movable, wherein one or both of the first and second securing members is movable between an open position in which a mating connector of the electrical connector is positioned between the first and second securing members, and a clamped position in which the mating connector is securely clamped between the first and second securing members;

opposed end brackets extending from the base, wherein the first securing member is moveably secured between the opposed end brackets; and opposed side brackets extending from the base, wherein the second securing member is moveably secured between the opposed side brackets, wherein the second securing member comprises a channel through which the first securing member passes and moves, and wherein the first and second securing members are configured to receive the electrical connector from an engaging robot.

37. A system for manufacturing an electrical connector, the system comprising:

a plurality of mating connectors, wherein at least two of the plurality of mating connectors differ in one or both of size and shape;

a first engaging robot having an end effector that is configured to grasp each of the plurality of mating connectors;

a connector support assembly configured to securely retain each of the plurality of the mating connectors, wherein the first engaging robot is configured to position one of the plurality of mating connectors into the connector support assembly, wherein the connector support assembly comprises:

a base;

a first securing member; and a second securing member, wherein one or both of the first and second securing members is movable, and wherein one or both of the first and second securing members is movable between an open position in which one of the plurality of mating connectors is positioned between the first and second securing members, and a clamped position in which the one of the plurality of mating connectors is securely clamped between the first and second securing members;

a conveyor configured to convey the connector support assembly;

a pallet configured to moveably secure the base of the connector support assembly to the conveyor; and one or more automated tools connected to the conveyor, wherein the one or more automated tools are configured to secure one or more components to the one of the plurality of mating connectors.

38. A method for manufacturing an electrical connector, the method comprising:

storing a plurality of mating connectors, wherein at least two of the plurality of mating connectors differ in one or both of size and shape;

grasping one of the plurality of mating connectors with an end effector of a first engaging robot;

moving the one of the plurality of mating connectors with the end effector to a connector support assembly;

actuating one or both of first and second securing members of the connector support assembly into an open position;

using the end effector to position the one of the plurality of mating connectors between the first and second securing members;

securely clamping the one of the plurality of the mating connectors between the first and second securing members;

securing a base of the connector support assembly to a pallet;

moveably securing the pallet to a conveyor; and conveying the connector support assembly to one or more automated tools.

39. A connector support assembly configured to securely retain an electrical connector during a manufacturing process, the connector support assembly comprising:

a pallet;

a base supported on the pallet, wherein the connector support assembly is conveyed on a conveyor by the pallet;

a first securing member; and a second securing member, wherein one or both of the first and second securing members is movable, wherein one or both of the first and second securing members is movable between an open position in which a mating connector of the electrical connector is positioned between the first and second securing members, and a clamped position in which the mating connector is securely clamped between the first and second securing members, and wherein the first and second securing members are configured to receive the electrical connector from an engaging robot.

* * * * *